US009717943B2

(12) United States Patent
Klonoski

(10) Patent No.: US 9,717,943 B2
(45) Date of Patent: Aug. 1, 2017

(54) RETRACTABLE DUMBBELL SUPPORT

(71) Applicant: Michael Klonoski, Haddam, CT (US)

(72) Inventor: Michael Klonoski, Haddam, CT (US)

( * ) Notice: Subject to any disclaimer, the term of this patent is extended or adjusted under 35 U.S.C. 154(b) by 597 days.

(21) Appl. No.: 13/971,471

(22) Filed: Aug. 20, 2013

(65) Prior Publication Data

US 2014/0084117 A1 Mar. 27, 2014

Related U.S. Application Data

(60) Provisional application No. 61/691,038, filed on Aug. 20, 2012.

(51) Int. Cl.

*A63B 21/078* (2006.01)
*A63B 71/00* (2006.01)
*A63B 21/072* (2006.01)

(52) U.S. Cl.

CPC ..... *A63B 21/078* (2013.01); *A63B 71/0036* (2013.01); *A63B 21/0726* (2013.01)

(58) Field of Classification Search

CPC ..... A63B 21/078; A63B 21/0783; A63B 21/4029; A63B 21/4031; A63B 21/062; A63B 21/0622; A63B 21/0624; A63B 21/0626

See application file for complete search history.

(56) References Cited

U.S. PATENT DOCUMENTS

| | | | | |
|---|---|---|---|---|
| 2,741,300 | A | 4/1955 | Tubbs et al. | |
| 5,472,397 | A * | 12/1995 | Ammoscato ..... | A63B 21/4029 482/104 |
| 5,509,876 | A | 4/1996 | Reyes | |
| 5,954,619 | A | 9/1999 | Petrone | |
| 5,971,898 | A | 10/1999 | Schoolfield | |
| 6,350,221 | B1 | 2/2002 | Krull | |
| 7,001,314 | B1 | 2/2006 | Hummer, Jr. | |
| 7,070,547 | B1 | 7/2006 | Pater | |
| 7,326,160 | B2 | 2/2008 | Savage et al. | |
| 7,534,198 | B1 | 5/2009 | Strong | |
| 7,578,771 | B1 | 8/2009 | Towley, III et al. | |
| 7,914,424 | B1 | 3/2011 | Krull | |
| 2007/0049472 | A1 | 3/2007 | Hummer, Jr. | |
| 2007/0082795 | A1 | 4/2007 | Murray et al. | |

* cited by examiner

*Primary Examiner* — Loan H Thanh
*Assistant Examiner* — Rae Fischer
(74) *Attorney, Agent, or Firm* — Steven M. McHugh

(57) ABSTRACT

A dumbbell support system is provided and includes a support structure, a biasing article and a system support, wherein the system support is securely associated with the support structure. The system support includes a barbell support having a barbell support shaft and a dumbbell support shaft guide. The system support also includes a dumbbell support having a dumbbell support shaft and a dumbbell support tray, wherein the dumbbell support shaft is connected to the biasing article and movably associated with the barbell support shaft to be configurable between a first configuration and a second configuration via the biasing article.

12 Claims, 48 Drawing Sheets

RETRACTABLE DUMBBELL SUPPORT

CROSS REFERENCE TO RELATED APPLICATIONS

This application is related to and claims the benefit of the filing date of U.S. Provisional Patent Application Ser. No. 61/691,038 filed Aug. 20, 2012, the contents of which is incorporated herein by reference in its entirety.

FIELD OF THE INVENTION

This invention relates generally to a support device for dumbbells and more particularly to a portable dumbbell support device which is usable with existing weight benches.

BACKGROUND OF THE INVENTION

Weight lifting to generate muscle growth or increase muscle tone is well known to athletes and non-athletes alike. As such, free weights, weight benches and universal weight sets have become a popular item with people looking to exercise and lift weights in the privacy of their own home. Weight lifting typically includes several types of exercises that concentrate on specific areas of the body, such as chest, shoulders, arms and legs. Universal weight sets are ideal for this type of exercise and are typically constructed such that a central stack of weights can be used to perform several different types of exercises that 'work' one or more general group of muscles. Unfortunately, because the weights typically cannot be removed from the universal weight set, the exercises are defined and the user cannot use the weights outside of the defined usage.

For this reason, the more serious or experience weight lifters favor the use of "free weights" or weights that are not connected to a universal machine. Free weights allow a lifter to not only work a general muscle group (such as chest, arms, etc.), but they also allow a lifter to concentrate on specific muscles within a general muscle group. For example, one of the more common weight lifting tools is a bench press bench 100, as shown in FIG. 1. The bench press bench 100 typically includes a bench portion 102 and a barbell cradle 104, where the user would rest a barbell 106 having weights 108 in the barbell cradle 104 and lay on the bench portion 102 to be at least partially under the barbell 106. The user would then lift the barbell 106 off of the barbell cradle 104 and proceed to 'bench' the barbell 106 and weights 108. When finished, the user would then place the barbell 106 back into the barbell cradle 104. In some bench press benches 100, the bench portion 102 is configurable between a flat configuration and an angled (inclined/declined) configuration. This inclination/declination ability allows the user to concentrate the bench press exercise on specific areas of the chest.

In a similar fashion, more experience weight lifters like to use the bench press bench 100 for dumbbell presses to better isolate exercises to specific chest and arm areas. Unfortunately, current barbell cradles 104 are not able to work with dumbbells due to their size and configuration. Accordingly, the user must hold the dumbbells and get into position for performing the dumbbell press. While this is easily accomplished with dumbbells having lighter weights, the difficulty increases as the weight increases. One method to overcome this issue involves weight benches that are custom designed to work with dumbbells. Unfortunately, these types of specialized weight benches are expensive, complicated and limited in uses. Another method involves an "add on" that is mounted to an existing bench that is designed to work with dumbbells. Unfortunately, this type of addition must be customized to the bench the user is using.

SUMMARY OF THE INVENTION

A retractable dumbbell support article is provided and includes a support structure, a biasing article, a first system support and a second system support, wherein each of the first system support and second system support are associated with the support structure and includes, a barbell support having a barbell support shaft and a dumbbell support shaft guide and a dumbbell support having a dumbbell support shaft and a dumbbell support tray, wherein the dumbbell support is movably associated with the barbell support, and wherein the biasing article is connected to the dumbbell support to configure the dumbbell support between a first configuration and a second configuration.

Moreover, a dumbbell support system is provided and includes a support structure, a biasing article and a system support, wherein the system support is securely associated with the support structure. The system support includes a barbell support having a barbell support shaft and a dumbbell support shaft guide. The system support also includes a dumbbell support having a dumbbell support shaft and a dumbbell support tray, wherein the dumbbell support shaft is connected to the biasing article and movably associated with the barbell support shaft to be configurable between a first configuration and a second configuration via the biasing article.

Furthermore, a method for positioning a dumbbell using a retractable dumbbell support article having a support structure, a biasing article and a system support is provided, wherein the method includes obtaining the dumbbell support system wherein the system support includes a dumbbell support and a barbell support, wherein the dumbbell support includes a dumbbell tray. The method further includes positioning the dumbbell support into a first configuration, locating a dumbbell having weight on the dumbbell tray, such that the dumbbell support remains in the extended configuration and configuring the dumbbell support between the first configuration and a second configuration when the weight is removed from the dumbbell tray.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike:

FIG. 4B is a front view of a support guide structure of the retractable dumbbell support system of FIG. 2, in accordance with one embodiment of the invention.

DETAILED DESCRIPTION OF THE INVENTION

Figure 1:
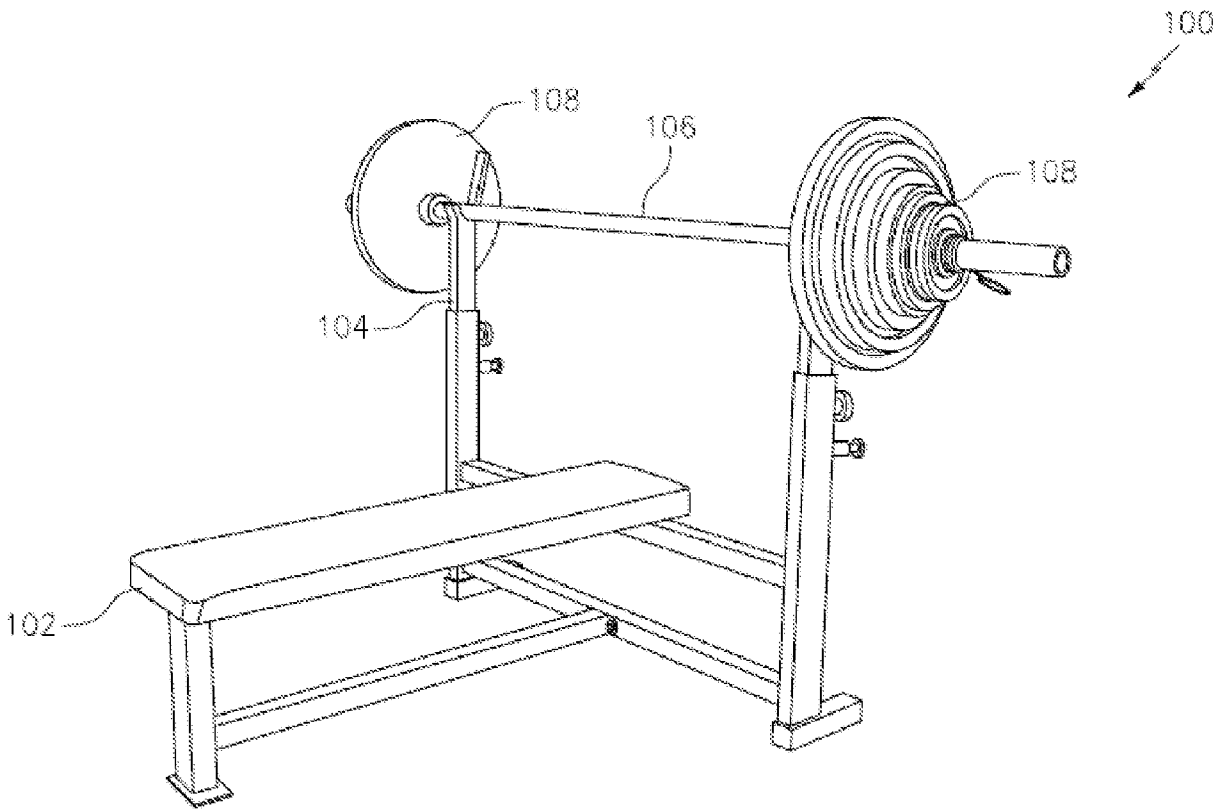
FIG. 1 Prior Art
FIG. 1 is an isometric side view of a common bench press bench, in accordance with the prior art.
Figure 2:
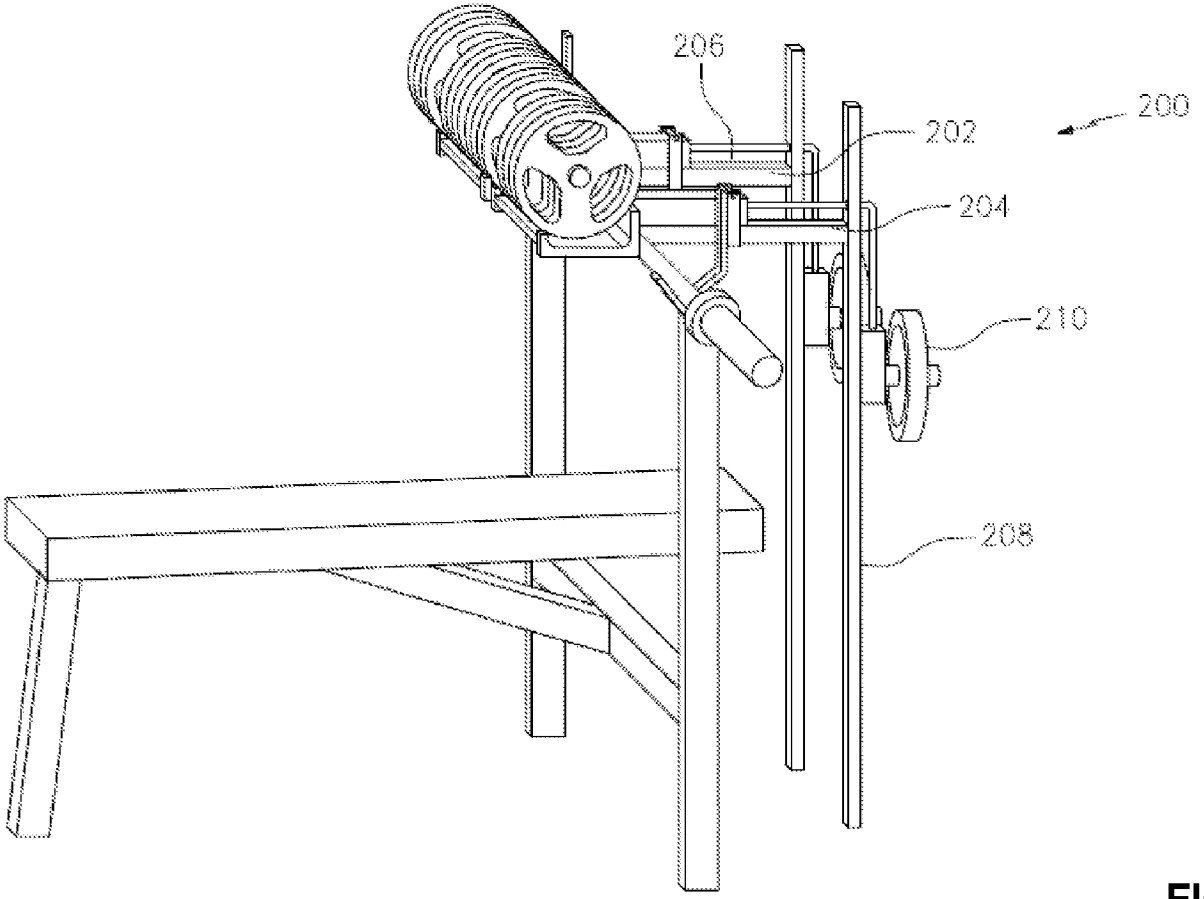
FIG. 2 is an isometric side view of a retractable dumbbell support system associated with a bench press bench, in accordance with one embodiment of the present invention.

In accordance with one embodiment of the present invention, a retractable dumbbell support system 200 is disclosed and is shown in FIG. 2. As can be seen, the dumbbell support system 200 includes a first dumbbell support assembly 202 and a second dumbbell support assembly 204, wherein each of the first dumbbell support assembly 202 and second dumbbell support assembly 204 includes at least one system support 206, at least one system support leg 208 and at least one retraction article 210 (retraction article 210 may also be only one element that is shared by both first and second dumbbell support assemblies 202, 204).

Figure 3:
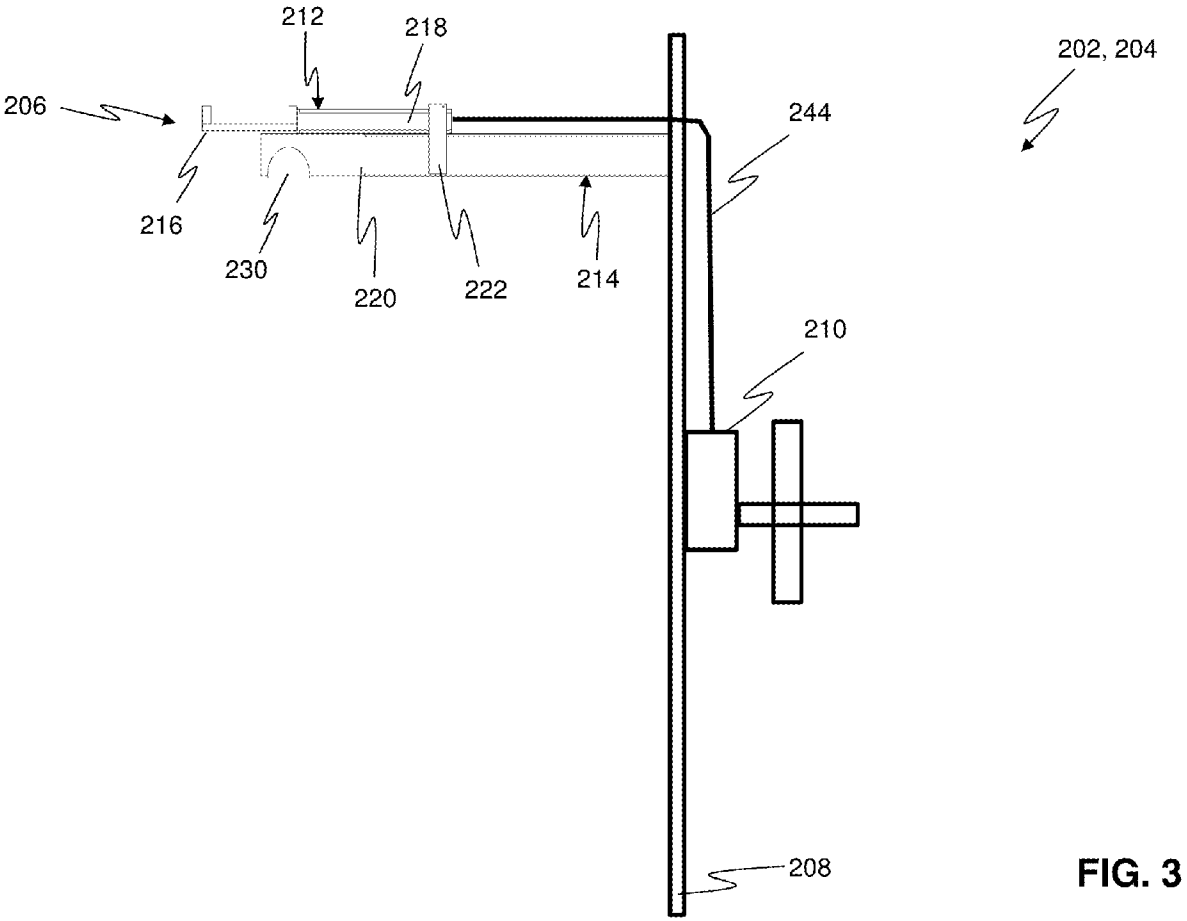
FIG. 3 is a side view of the retractable dumbbell support system of FIG. 2, in accordance with one embodiment of the invention.
Figure 4A:
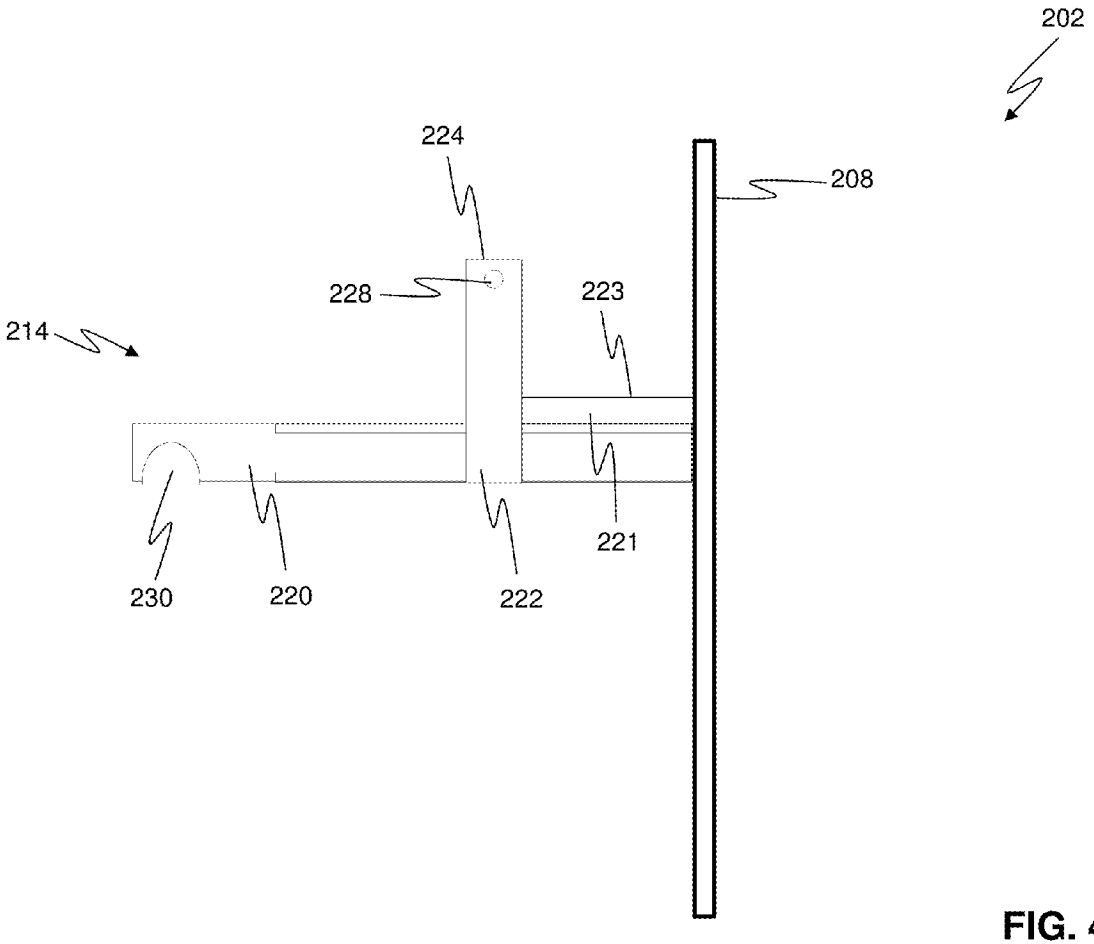
FIG. 4A is a side view of a barbell support of the retractable dumbbell support system of FIG. 2, in accordance with one embodiment of the invention.

Referring to FIG. 3, FIG. 4A and FIG. 4B, each system support 206 includes a dumbbell support 212 and a barbell support 214. The barbell support 214 includes a barbell support shaft 220 and a dumbbell support shaft guide 222 and is securely attached to at least one system support leg 208. The dumbbell support shaft guide 222 is securely attached to the barbell support shaft 220 and includes a support guide structure 224 that defines a guide cavity 226 and includes a securely attached anchoring pin 228 that extends across the guide cavity 226.

Figure 5:
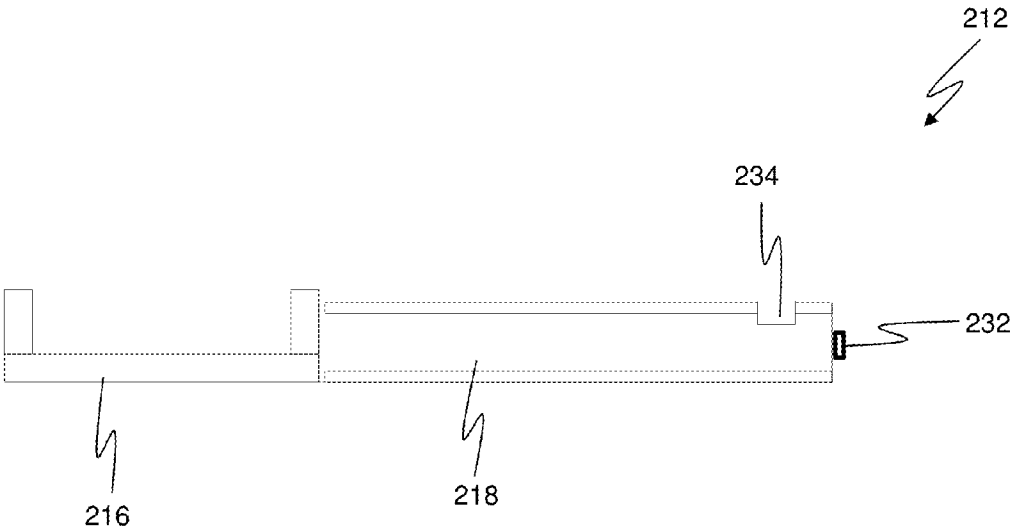
FIG. 5 is a side view of a dumbbell support of the retractable dumbbell support system of FIG. 2, in accordance with one embodiment of the invention.

Referring to FIG. 5, the dumbbell support 212 includes a dumbbell support tray 216 and a dumbbell support shaft 218, wherein the dumbbell support tray 216 is securely connected to the dumbbell support shaft 218 and is configured to supportingly contain a dumbbell having weight. Additionally, the dumbbell support shaft 218 includes a shaft cable hook 232 and defines a support body pin cavity 234. It should be appreciated that although the invention is disclosed herein as having two dumbbell support assemblies, it is contemplated that the invention may be configured to have only one dumbbell support assembly configured to have two (2) dumbbell support trays 216.

Figure 6A:
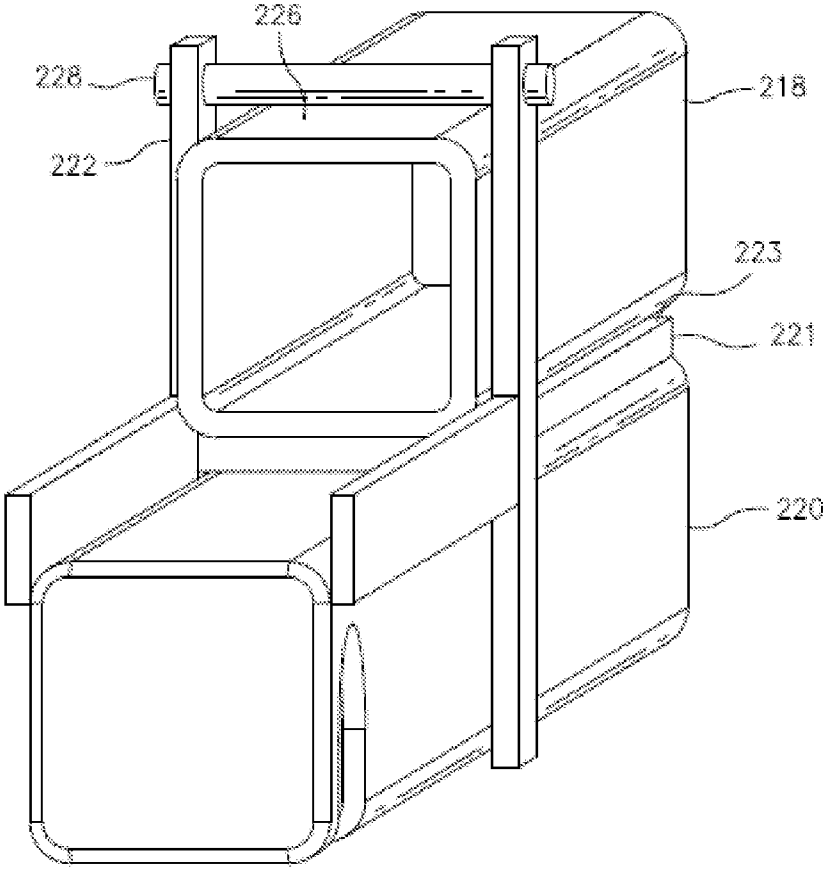
FIG. 6A is a perspective sectional view of a dumbbell support shaft in the retracted configuration interacting with the barbell support shaft of the retractable dumbbell support system of FIG. 2, in accordance with one embodiment of the invention.
Figure 6B:
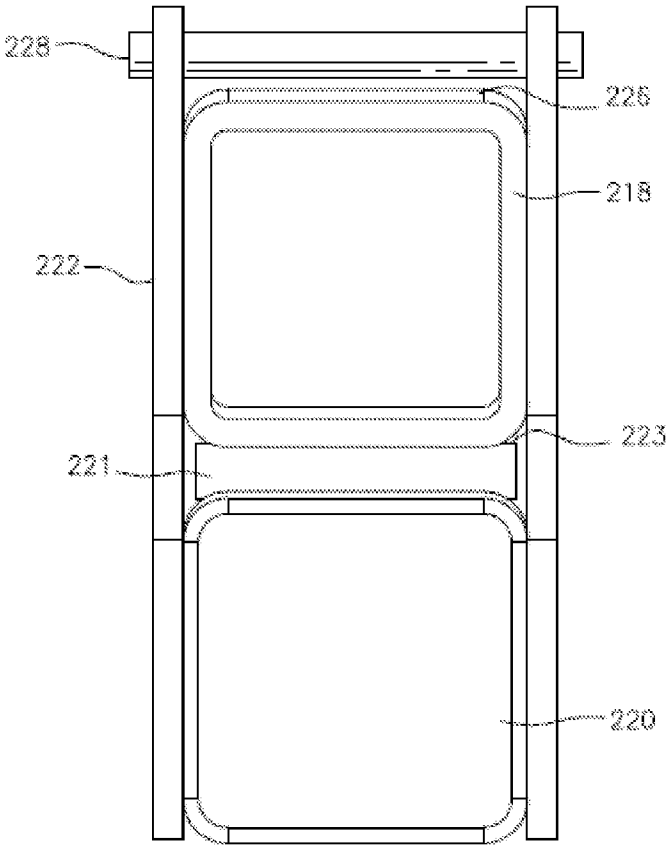
FIG. 6B is a front view of a dumbbell support shaft interacting with the barbell support shaft of the retractable dumbbell support system of FIG. 2, in accordance with one embodiment of the invention.
Figure 6C:
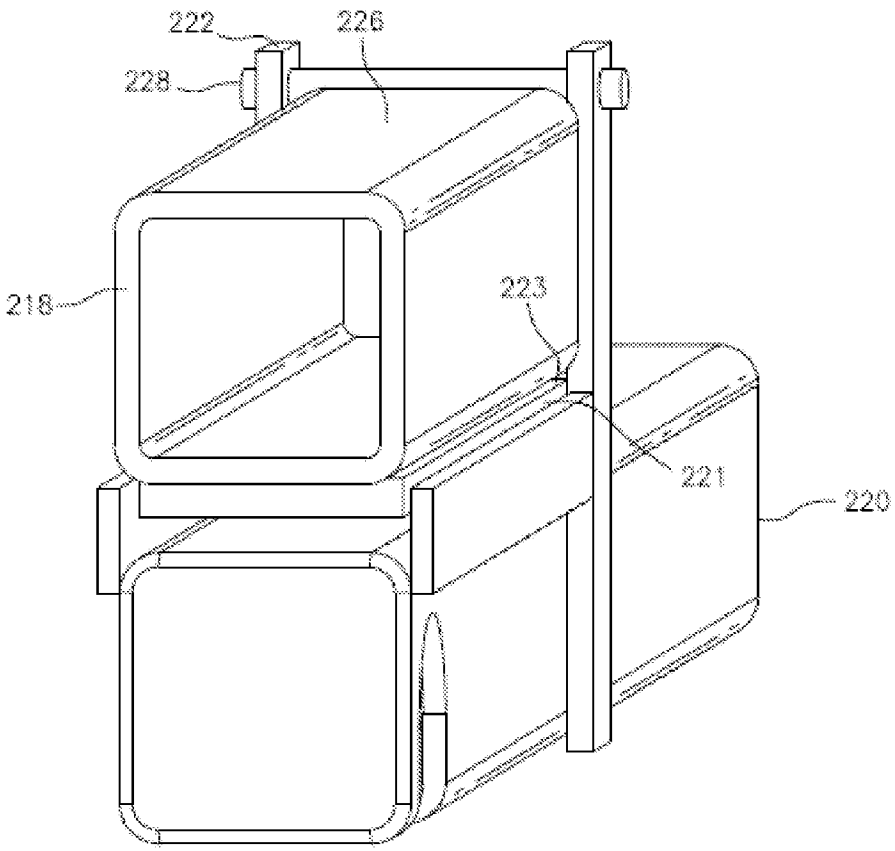
FIG. 6C is a perspective sectional view of a dumbbell support shaft in the extended configuration interacting with the barbell support shaft of the retractable dumbbell support system of FIG. 2, in accordance with one embodiment of the invention.

Referring again to FIG. 3 and FIG. 4A, the barbell support shaft 220 defines a barbell support shaft cavity 230 configured to interface with and contain a barbell 106 and, in one embodiment may include an interface surface 221 (See FIG. 6A, FIG. 6B and FIG. 6C) which has a low friction top surface 223 (such as Ultra-High Molecular Weight Polyethylene UHMW) so that the dumbbell support shaft 218 can easily slide between an extended configuration and a retracted configuration as discussed further herein. In another embodiment, the dumbbell support shaft 218 may include an interface surface 302 (See FIG. 8A) which has a low friction surface 304 (such as a surface that was treated with a Ultra-High Molecular Weight Polyethylene UHMW material) so that the dumbbell support shaft 218 can easily slide between the extended configuration and the retracted configuration. In this configuration, a raised surface or lip 306 may be included on the top surface of the barbell support shaft 220 (or the bottom surface of the dumbbell support shaft 218) so that the dumbbell support shaft 218 can tilt thereby locating the anchoring pin 228 with the pin cavity 234. When the barbell support shaft 220 is associated with a barbell 106, the barbell support shaft 220 rests on the barbell 106 such that the barbell 106 is contained within the barbell support shaft cavity 230.

Referring to FIG. 3, FIG. 6A, FIG. 6B and FIG. 6C, the dumbbell support 212 is associated with the barbell support 214 such that the dumbbell support shaft 218 is at least partially located within the guide cavity 226 and slides along the low friction top surface 223 between an extended configuration (FIG. 6C) and a retracted configuration (FIG. 6A) as discussed further hereinafter.

Figure 7A:
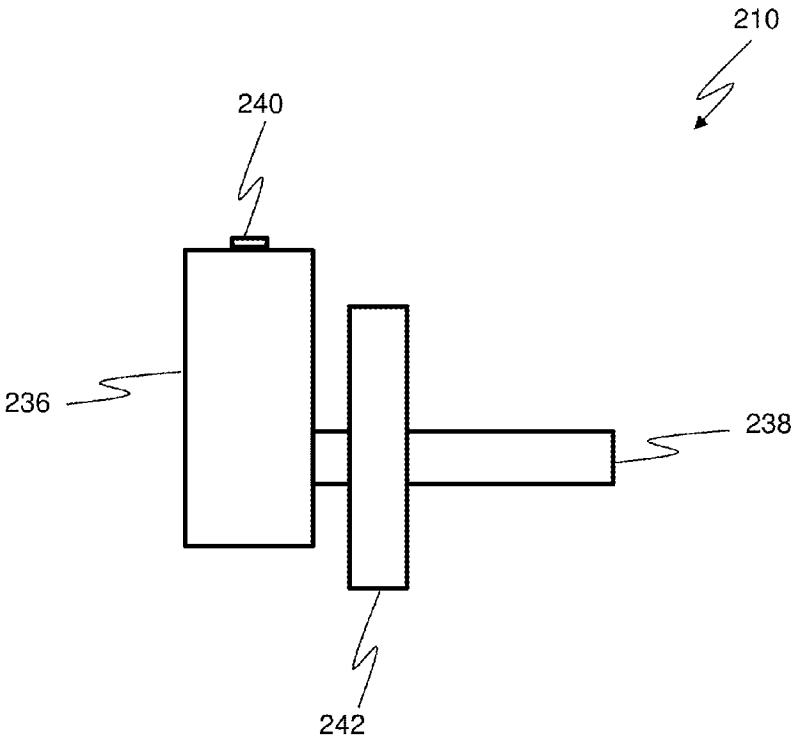
FIG. 7A is a side view of a retraction article of the retractable dumbbell support system of FIG. 2, in accordance with one embodiment of the invention.
Figure 7B:
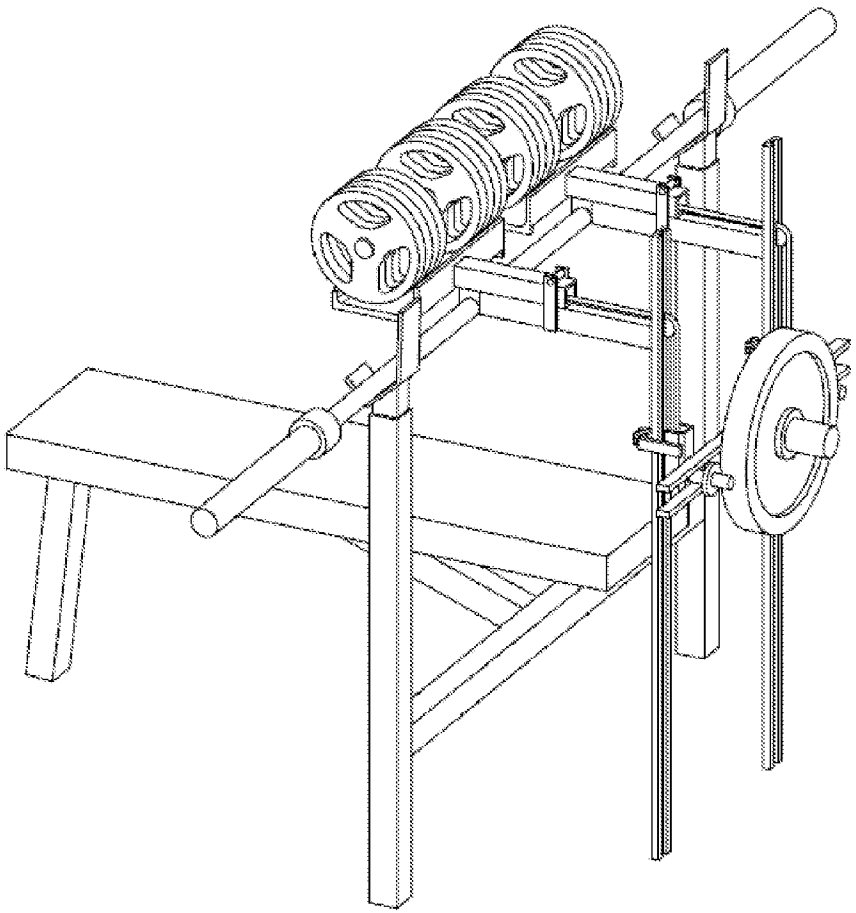
FIG. 7B is an isometric rear side view of a retractable dumbbell support system associated with a bench press bench having one retractor weight, in accordance with one embodiment of the present invention.

Referring to FIG. 7A, the retraction article 210 includes an article mounting device 236 and at least one retractor weight mounting peg 238, where the article mounting device 236 includes a retraction cable hook 240 and wherein the retractor weight mounting peg 238 is sized and shaped to fit within the center cavity of a common weight plate 242. It should be appreciated that as discussed herein, the portable retractable dumbbell support system 200 is shown as having a retraction article 210 associated with each support leg 208, where each retraction article 210 includes a retractor weight mounting peg 238 (one for each support leg 208) wherein a weight plate 242 would be located on each of the retractor weight mounting pegs 238. However, it is contemplated that the portable retractable dumbbell support system 200 may be configured to have only one retractor weight mounting peg 238 so that only one weight plate is needed to provide the retraction of the dumbbell support 212. One embodiment of this configuration is shown in FIG. 7B.

Referring again to FIG. 3, it should be appreciated that the barbell support shaft 220 is securely connected to the system support leg 208 and the dumbbell support 212 is movably associated with the barbell support shaft 220 via the dumbbell support shaft guide 222, such that the dumbbell support shaft 218 is at least partially and movingly contained within the dumbbell support guide cavity 226. This advantageously allows the dumbbell support 212 to slide or move along the low friction top surface 223 or the first top surface 221 of barbell support shaft 220 between an extended configuration and a retracted configuration.

Figure 8A:
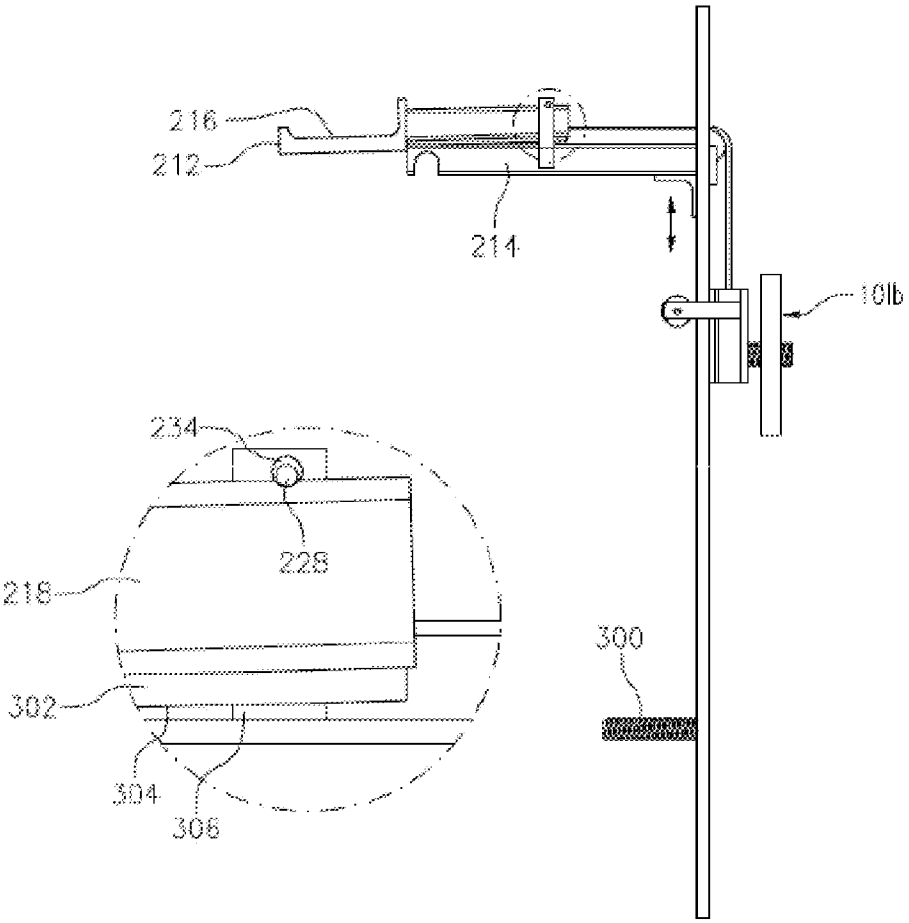
FIG. 8A is a side view of the retractable dumbbell support system of FIG. 2 in the extended configuration, in accordance with one embodiment of the invention.
Figure 8B:
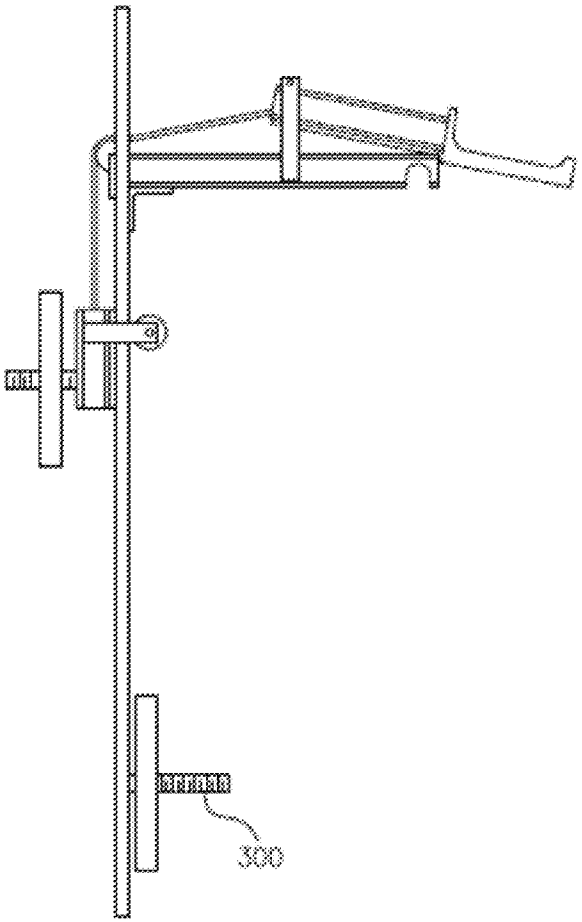
FIG. 8B is a side view of the retractable dumbbell support system of FIG. 2 in the extended configuration with an exaggerated tilt, in accordance with one embodiment of the invention.
Figure 8C:
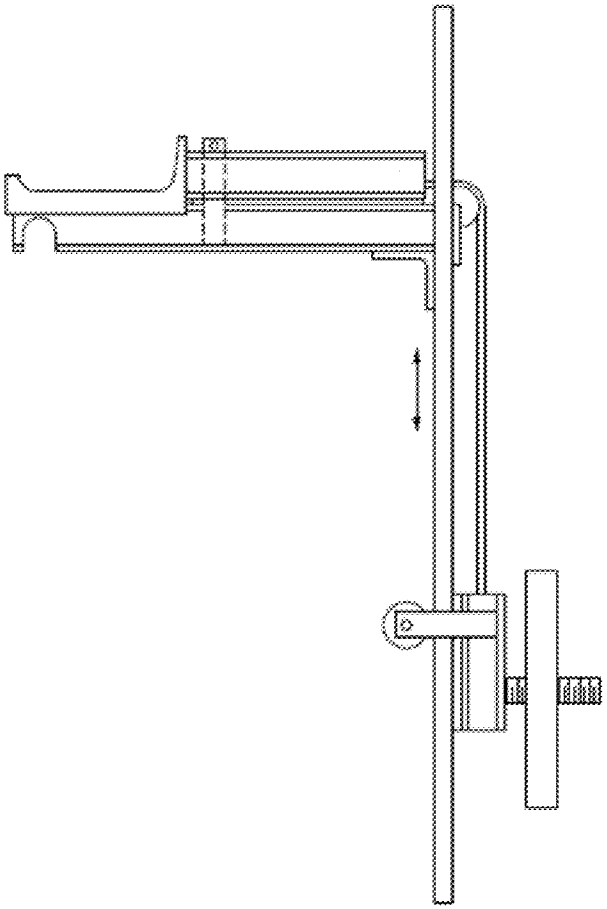
FIG. 8C is a side view of the retractable dumbbell support system of FIG. 2 in the retracted configuration, in accordance with one embodiment of the invention.

Referring to FIG. 8A and FIG. 8B, when configured in the extended configuration, the dumbbell support 212 is positioned relative to the barbell support 214 such that the support body pin cavity 234 is located proximate the anchoring pin 228. In this configuration, the dumbbell support tray 216 is located such that it extends (at least partially) past the end of the barbell support 214. When a dumbbell 244 having weight is located in the dumbbell support tray 216, the dumbbell support 212 is angled (tilted) in the direction of the weight such that the anchoring pin 228 is located within the support body pin cavity 234. Because the dumbbell support 212 is partially located on the raised surface or lip 306, when a weight is placed into the dumbbell support tray 216, the dumbbell support 212 tilts until the pin 228 is located in the support body pin cavity 234. Referring to FIG. 8B, this prevents the dumbbell support 212 from sliding out of the guide cavity 226 as is illustrated in an exaggerated view for illustration purposes. Referring to FIG. 8C, when configured in the retracted configuration, the dumbbell support 212 is positioned relative to the barbell support 214 such that dumbbell support tray 216 is located over the barbell support 214 and the support body pin cavity 234 is located away from the anchoring pin 228.

It should be further appreciated that the retraction article 210 is movably associated with the system support leg 208 to allow the retraction article 210 to move or slide along a portion of the length (height) of the system support leg 208 when being configured between the extended configuration and the retracted configuration. Furthermore, a retraction cable 244 is connected to both the body cable hook 232 and the retraction cable hook 240, such that when a common weight plate 242 is associated with the counterweight mounting peg 238, the downward force (i.e. due to the weight of the plate 242) generated by the weight of the common weight plate 242 causes the retraction article 210 to slide down the system support leg 208. This in turn causes the dumbbell support 212 to slide or move along the barbell support 214 toward the system support legs 208.

Figure 8D:
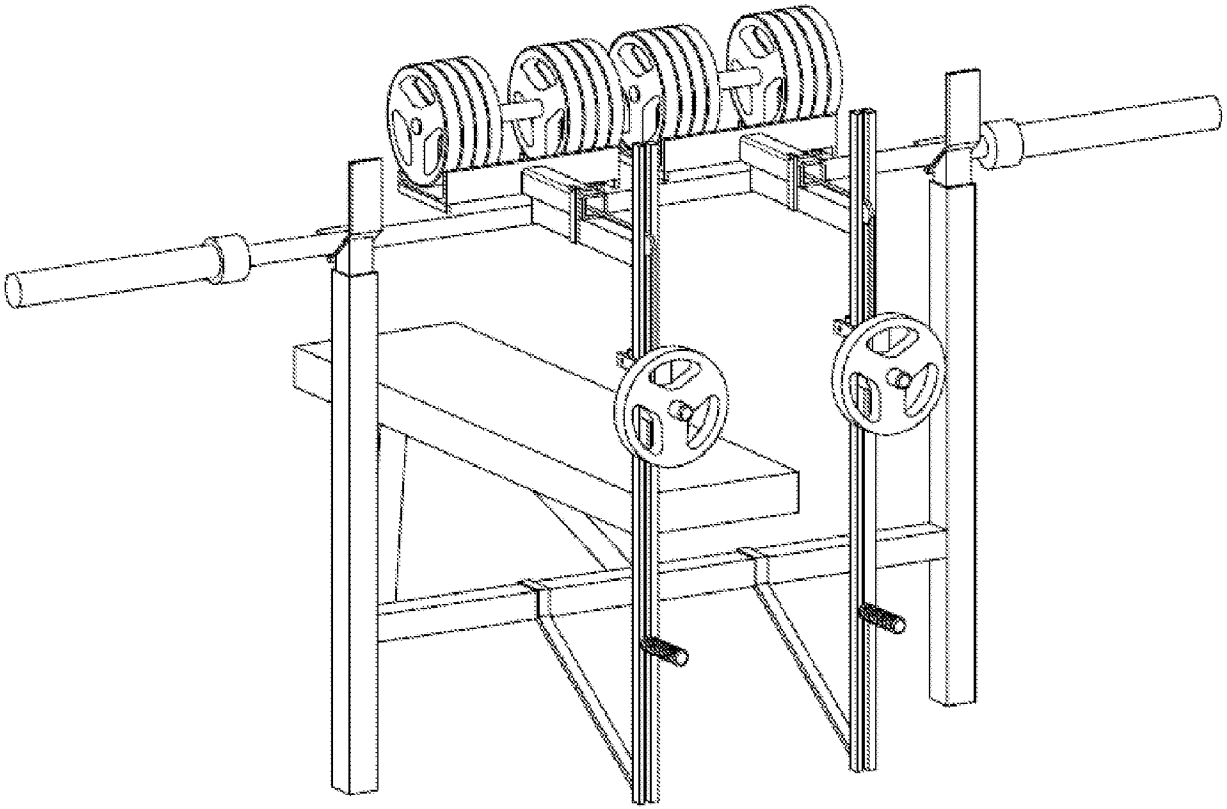
FIG. 8D is a rear perspective view of the retractable dumbbell support system of FIG. 2 with a strap counterbalance member, in accordance with another embodiment of the invention.

Referring again to FIG. 8A and FIG. 8B, the portable retractable dumbbell support system 200 may also include a counterbalance member 300, wherein the counterbalance member 300 may be a pin for holding a weight or the counterbalance member 300 may be any type of anchoring and/or counterbalancing device suitable to the desired end purpose, such as a strap (See FIG. 8D) that connects to the weight bench 102 (such as the support legs of the weight bench 102). This advantageously stabilizes the portable retractable dumbbell support system 200 by preventing it from falling onto the user when weight is placed in the dumbbell support trays 216. This may be necessary when a certain amount of weight is applied to the dumbbell support trays 216.

Figure 9:
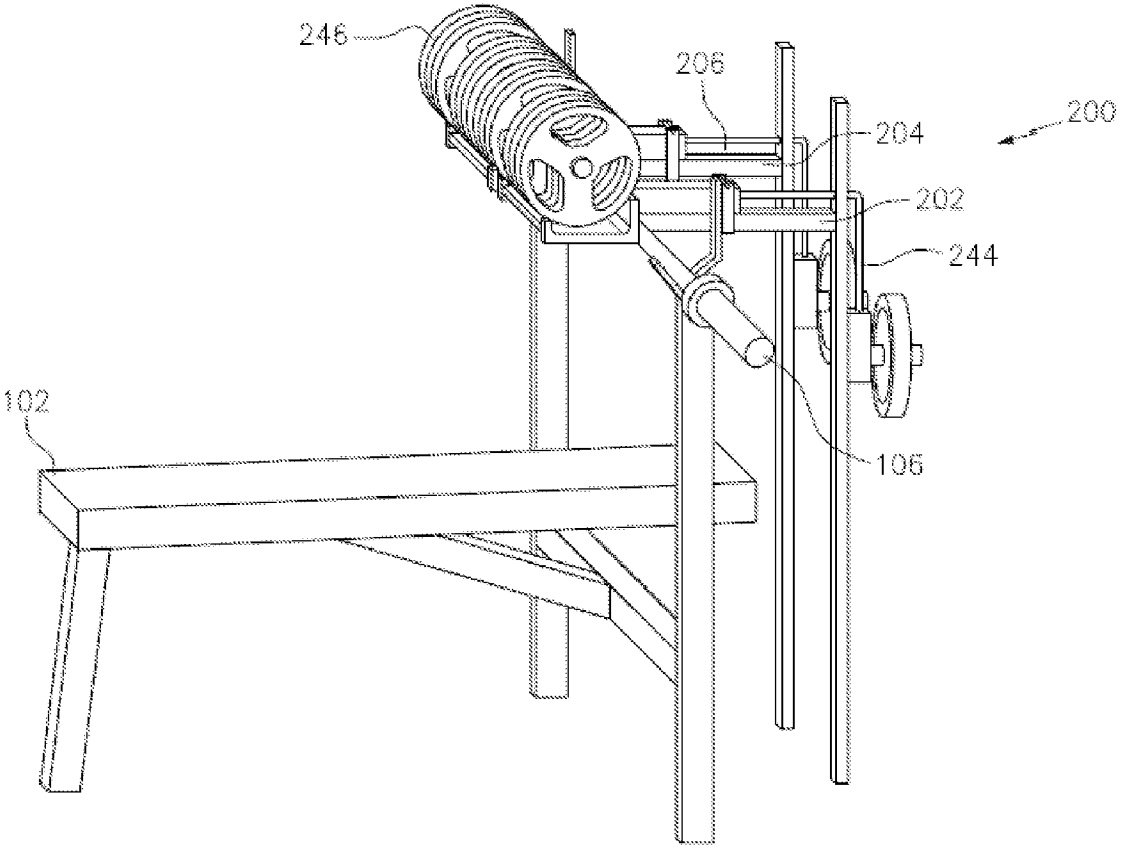
FIG. 9 is an isometric side view of the retractable dumbbell support system of FIG. 2 in the extended configuration with dumbbells in the dumbbell support tray associated with a bench press bench, in accordance with one embodiment of the invention.
Figure 10:
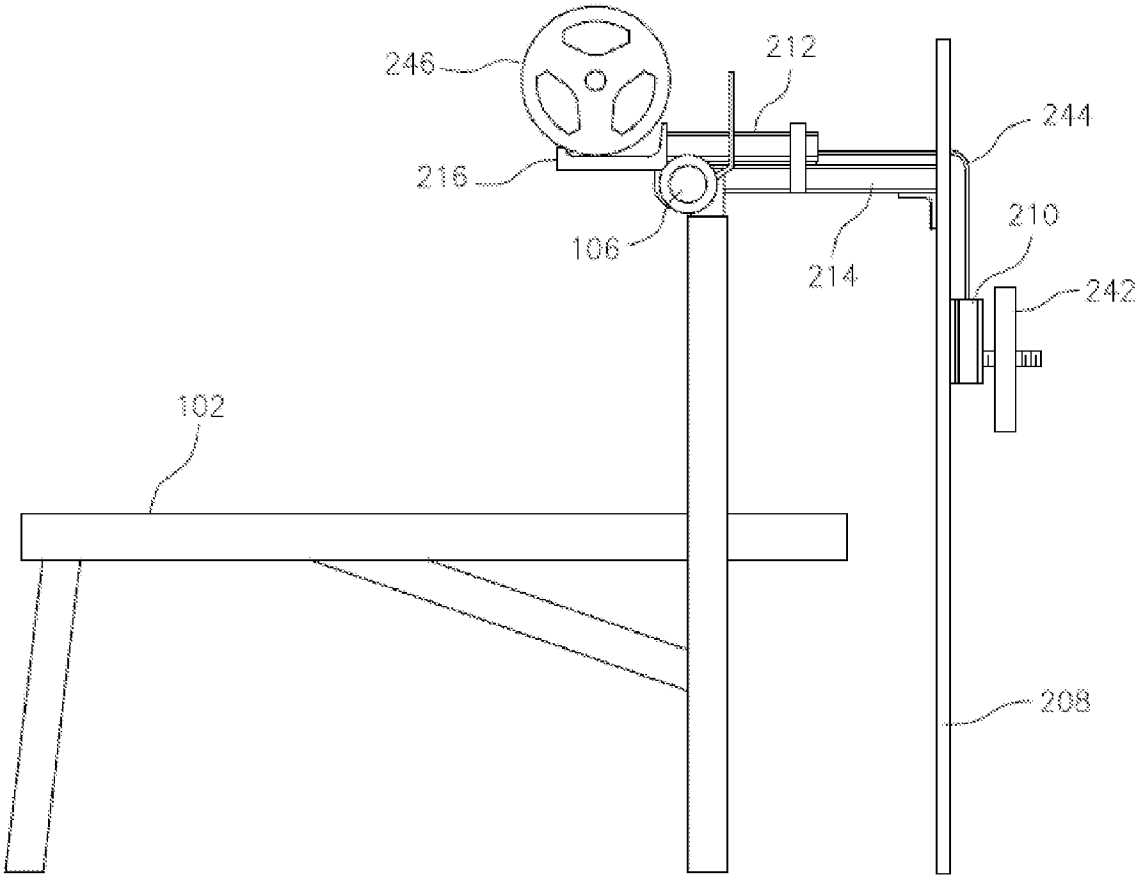
FIG. 10 is a side view of the retractable dumbbell support system of FIG. 2 in the extended configuration with dumbbells in the dumbbell support tray associated with a bench press bench, in accordance with one embodiment of the invention.
Figure 11:
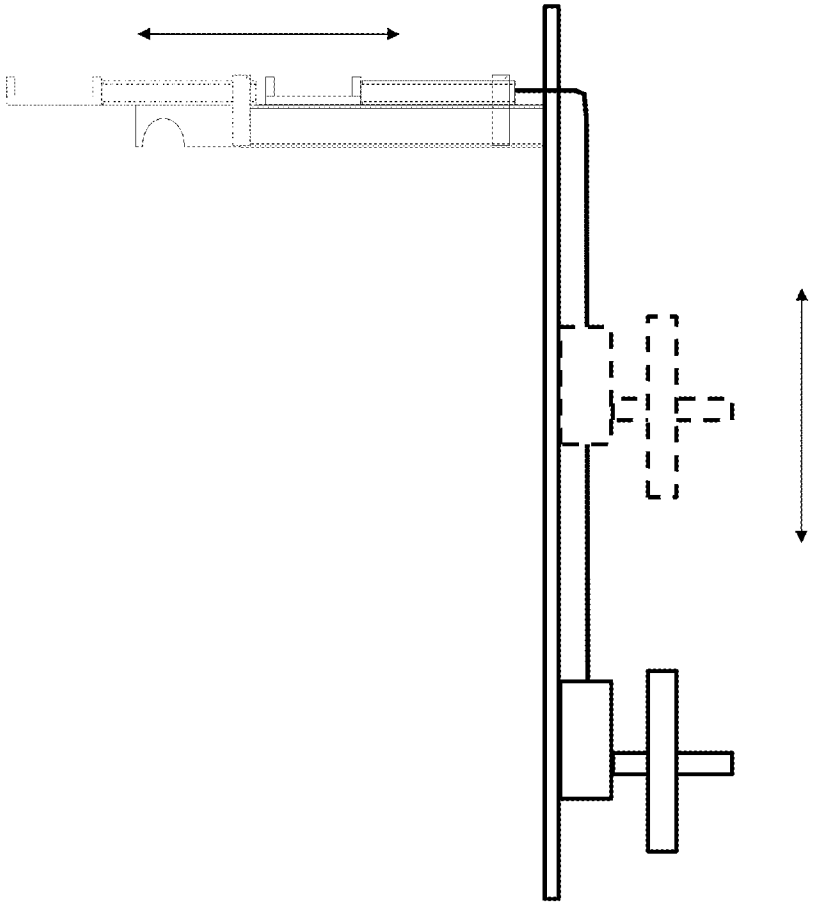
FIG. 11 is a side view of the retractable dumbbell support system of FIG. 2 showing the retractable dumbbell support system being configured from an extended configuration into a retracted configuration, in accordance with one embodiment of the invention.

In accordance with one embodiment of the invention and referring to FIG. 9, FIG. 10 and FIG. 11, the portable retractable dumbbell support system 200 operates as follows. Referring to FIG. 9 and FIG. 10, the portable retractable dumbbell support system 200 is associated with the barbell 106 of a common weight bench 102, by positioning the barbell 106 within the barbell support shaft cavity 230 of the first dumbbell support assembly 202 and the second dumbbell support assembly 204. The dumbbell supports 212 are configured into the extended configuration and dumbbells 246 containing weights may be located in the dumbbell support trays 216 of each of the first dumbbell support assembly 202 and the second dumbbell support assembly 204. The weight of the dumbbells 246 cause the dumbbell supports 212 to tilt toward the dumbbells 246 such that the anchoring pin 228 is located within the support body pin cavity 234. The user is positioned on the bench 102 to be at least partially located under the dumbbells 246 and lifts the dumbbells 246 off of the dumbbell support trays 216. Once the dumbbells 246 are lifted off of the dumbbell support trays 216, the weight from the counterweight plate 242 causes the dumbbell supports 212 to return to the horizontal position and slide into the retracted position (See FIG. 11) to be out of the way of the operator when they are bench pressing the dumbbells 246.

It should be appreciated that when in the extended configuration, the dumbbell support trays 216 may be proximately located over (or proximate and/or above) the mid-section/upper torso section of the user and the retraction article 210 may be located away from the bottom system support legs 208. A common weight plate 242 may be associated with the counterweight mounting peg 238 of each of the retraction articles 210 (or common mounting peg 238). When the user lies down on the bench to be in a substantially prone position (or angled if desired), the user removes the dumbbells 246 from the dumbbell support trays 216 and begins their weight lifting regime. Once the weight is removed from the dumbbell support trays 216, the weight from the common weight plate 242 causes the dumbbell support body 212 to slide along the barbell support 214 (or low friction surface) toward the system support legs 208. Thus, the dumbbell support trays 216 are advantageously moved out of the way of the user during the workout regime.

Figure 12:
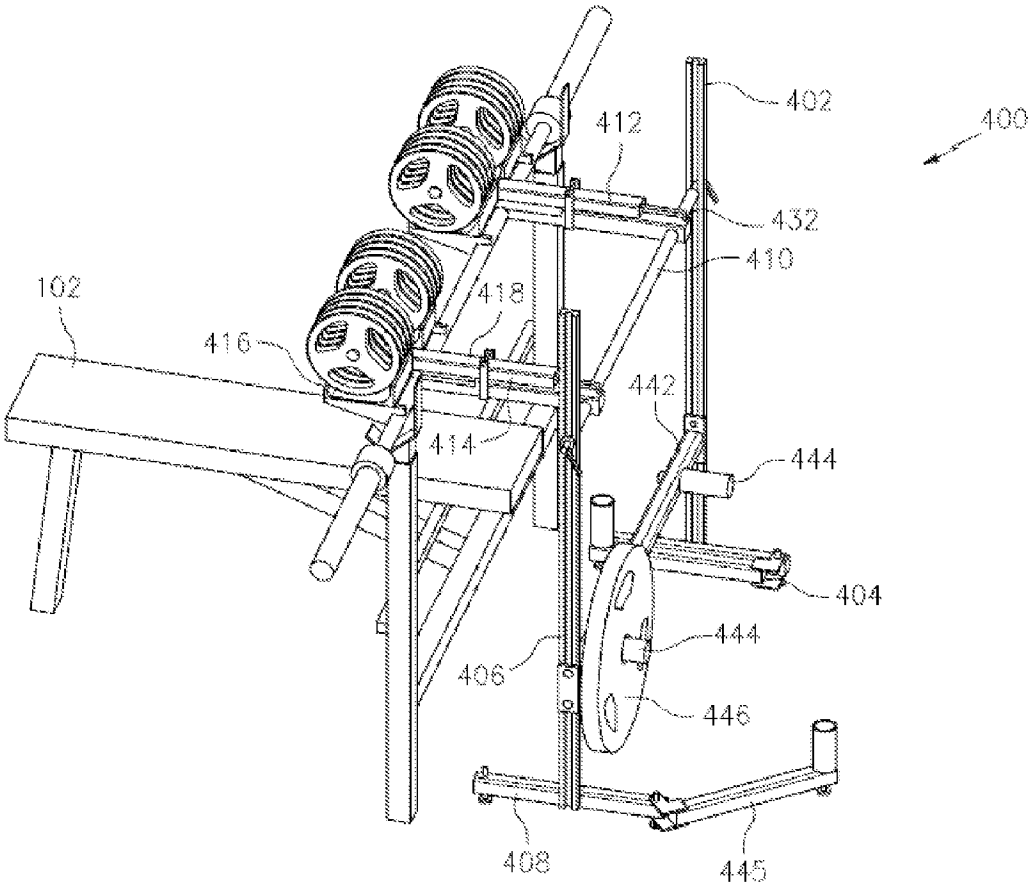
FIG. 12 is a top down side isometric view of a retractable dumbbell support system, in accordance with another embodiment of the invention.

It should be appreciated that in other embodiments, the retraction article may be a biasing element. Referring to FIG. 12, a dumbbell support system 400 that may be used with an existing weight bench 102 is shown in accordance with an additional embodiment of the invention. The dumbbell support system 400 may include a first support structure 402 having a first support base 404, a second support structure 406 having a second support base 408 and a support assembly mounting structure 410 which may be securely and movably attached to and located between the first support structure 402 and the second support structure 406. It should be appreciated that the support assembly mounting structure 410 may be movably and securely connected to the first support structure 402 and the second support structure 406, via any method or device suitable to the desired end purpose, such as a screw type connector, a spring type connector, a cam type compression device, a pin/hole type connection, etc. The dumbbell support system 400 may further include a first support system 412 and a second support system 414.

Figure 13:
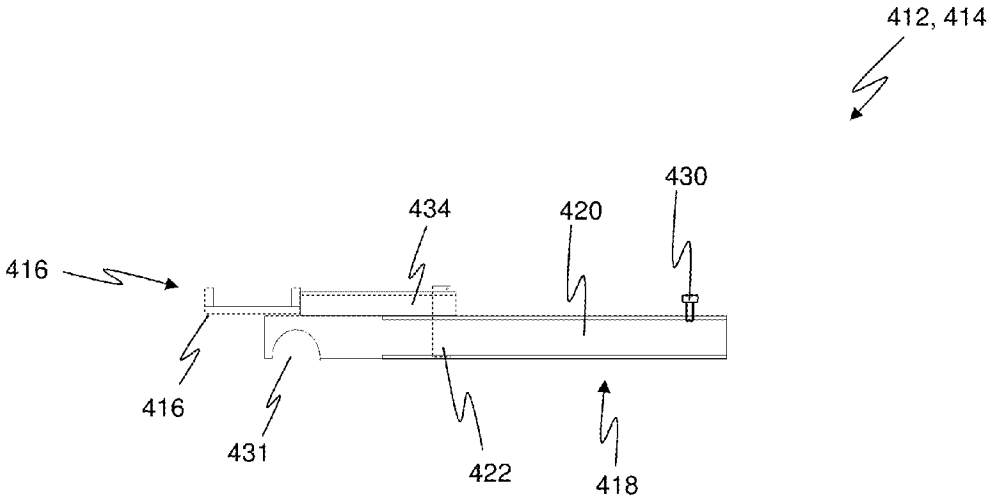
FIG. 13 is a side view of the dumbbell support and barbell support, in accordance with another embodiment of the invention.
Figure 14:
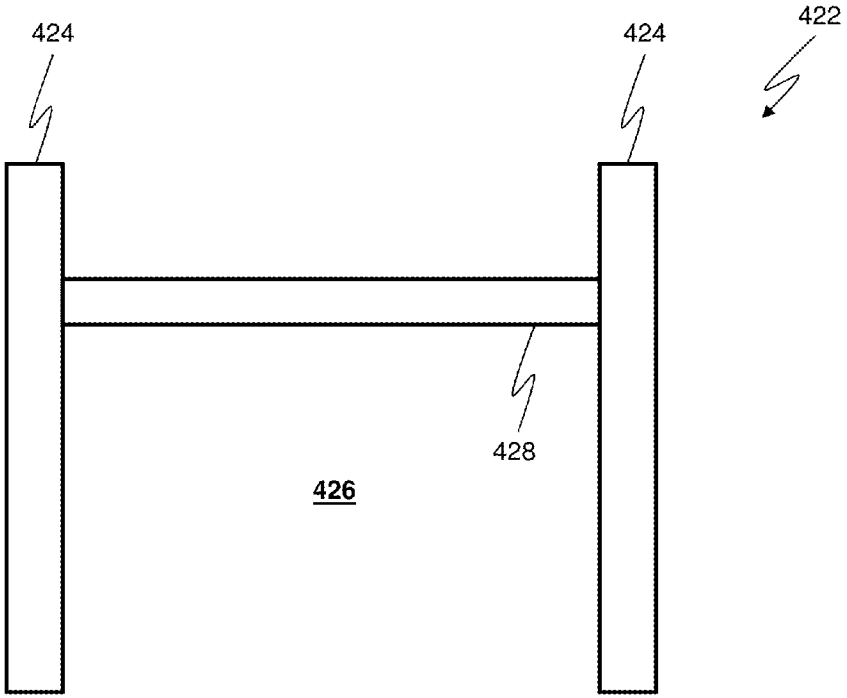
FIG. 14 is a front view of a support guide structure of the retractable dumbbell support system, in accordance with embodiments of the invention.

Referring to FIG. 13 and FIG. 14, it should be appreciated that each of the first support system 412 and second support system 414 includes a dumbbell support 416 and a barbell support 418. The barbell support 418 includes a barbell support shaft 420 and a dumbbell support shaft guide 422, where the dumbbell support shaft guide 422 is securely connected to the barbell support shaft 420 and wherein the barbell support shaft 420 is securely attached to the support assembly mounting structure 410. The dumbbell support shaft guide 422 is securely attached to the barbell support shaft 420 via a support guide structure 424 that defines a guide cavity 426 and includes a securely attached anchoring pin 428 that extends across the guide cavity 426. Moreover, the barbell support shaft 420 includes a first biasing member connector 430 and defines a barbell support shaft cavity 431 configured to interface with and contain a barbell 106. It should be appreciated that the dumbbell support shaft guide 422 may be securely connected to the barbell support shaft 420 via any device or method suitable to the desired end purpose, such as via a weld, screws, pins, etc. Moreover, it should be further appreciated that the barbell support shaft 420 may be securely attached to the support assembly mounting structure 410 via any device or method suitable to the desired end purpose, such as via a weld, screws, pins, etc.

Figure 15A:
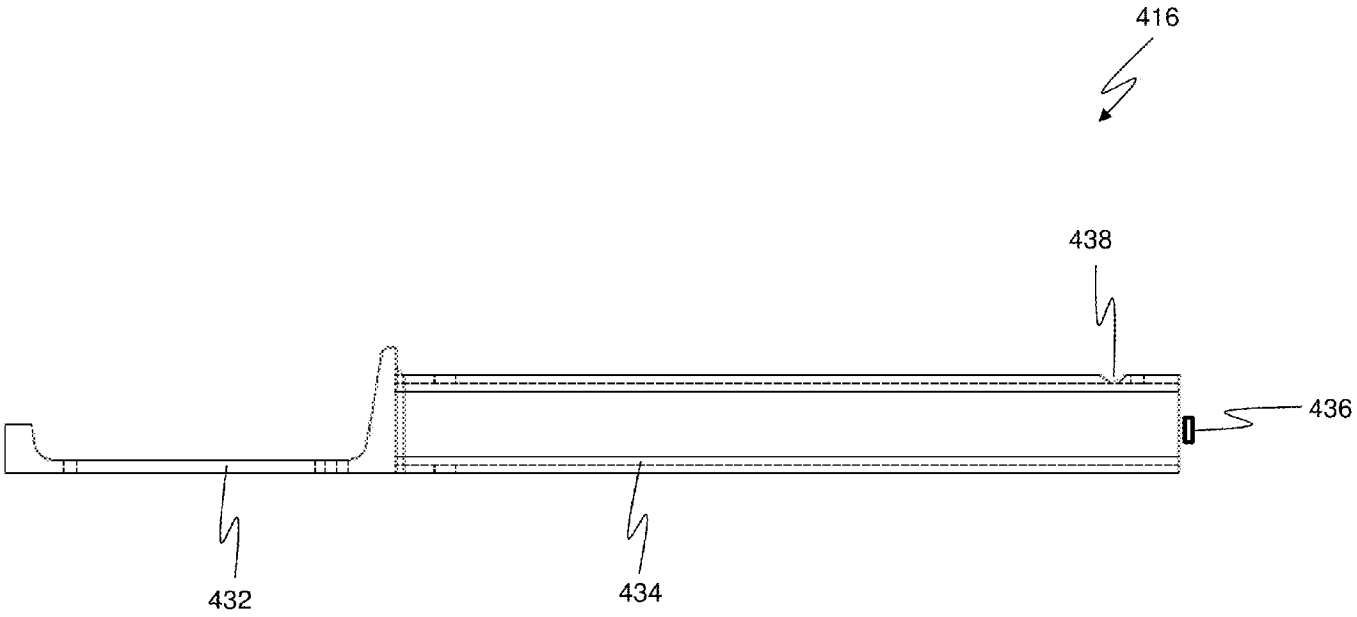
FIG. 15A is a side view of a dumbbell support of the retractable dumbbell support system, in accordance with one embodiment of the invention.
Figure 15B:
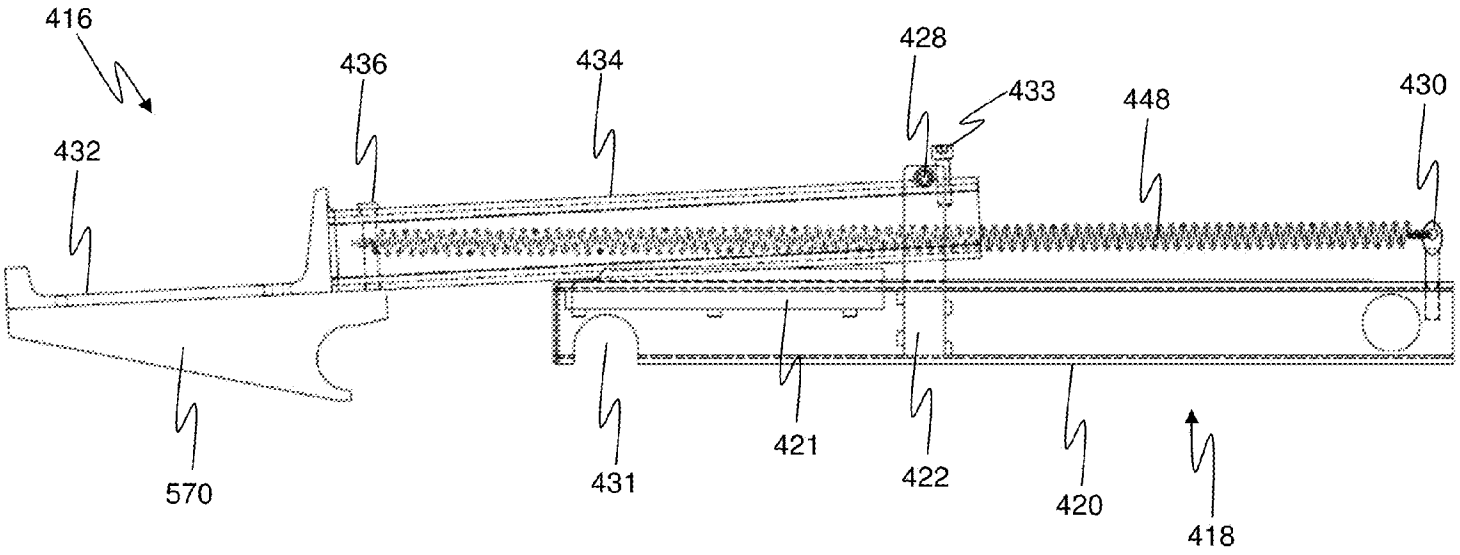
FIG. 15B is a side view of a dumbbell support of the retractable dumbbell support system, in accordance with another embodiment of the invention.

Referring to FIG. 15A and FIG. 15B, the dumbbell support 416 includes a dumbbell support tray 432 and a dumbbell support shaft 434, wherein the dumbbell support tray 432 is securely connected to the dumbbell support shaft 434 and is configured to supportingly contain a dumbbell having weight. Additionally, the dumbbell support shaft 434 includes a second biasing member connector 436 and defines a support body pin cavity 438 which is configured to interact with the anchoring pin 428. It should be appreciated that in one embodiment, the second biasing member connector 436 may be located on the back of the dumbbell support shaft 434 (as shown in FIG. 15A) and in additional embodiments, the second biasing member connector 436 may be located within a cavity that is defined by the structure of the dumbbell support shaft 434 (as shown in FIG. 15B). It should be appreciated that in some embodiments, the location of the second biasing member connector 436 may be important due to the tipping point of the dumbbell support 416. Moreover, it is contemplated that in some embodiments, a stop pin/screw 433 may be provided and may be located proximate the support body pin cavity 438 to interact with the anchoring pin 428 to prevent the dumbbell support 416 from being pulled out of the guide cavity when the dumbbell support 416 is in the extended configuration (See FIG. 15B).

Figure 15C:
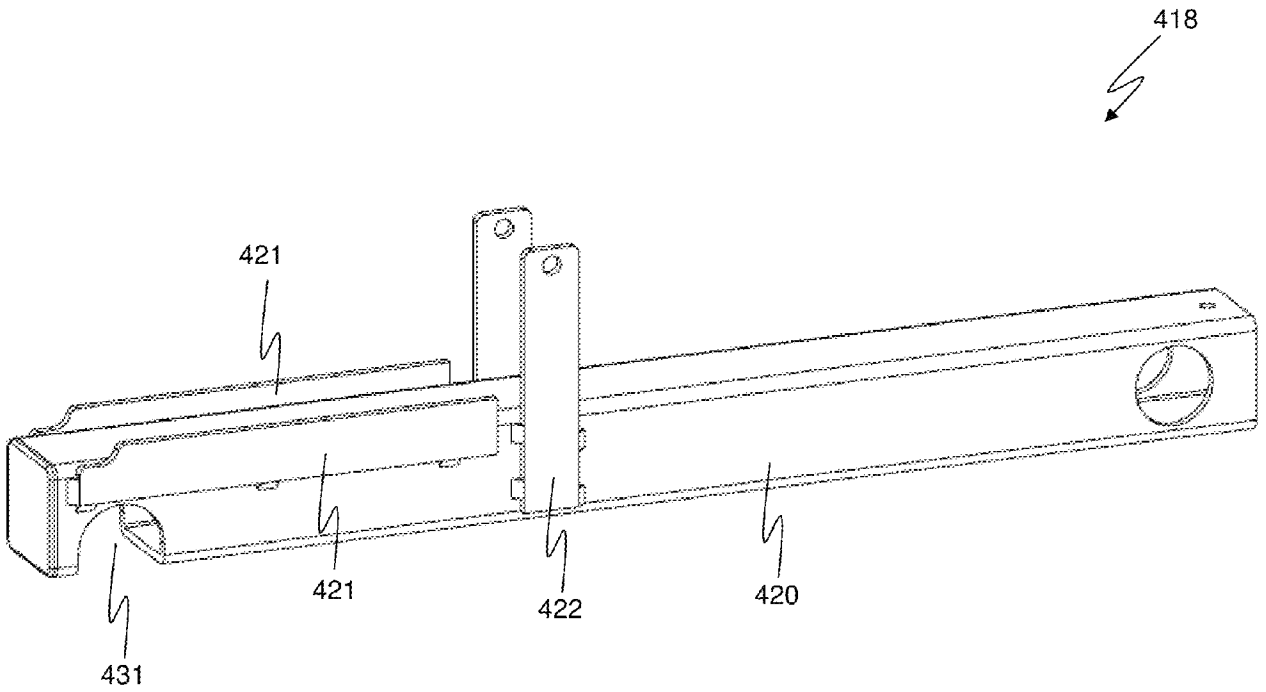
FIG. 15C is a side perspective view of a barbell support of the retractable dumbbell support system, in accordance with one embodiment of the invention.
Figure 15D:
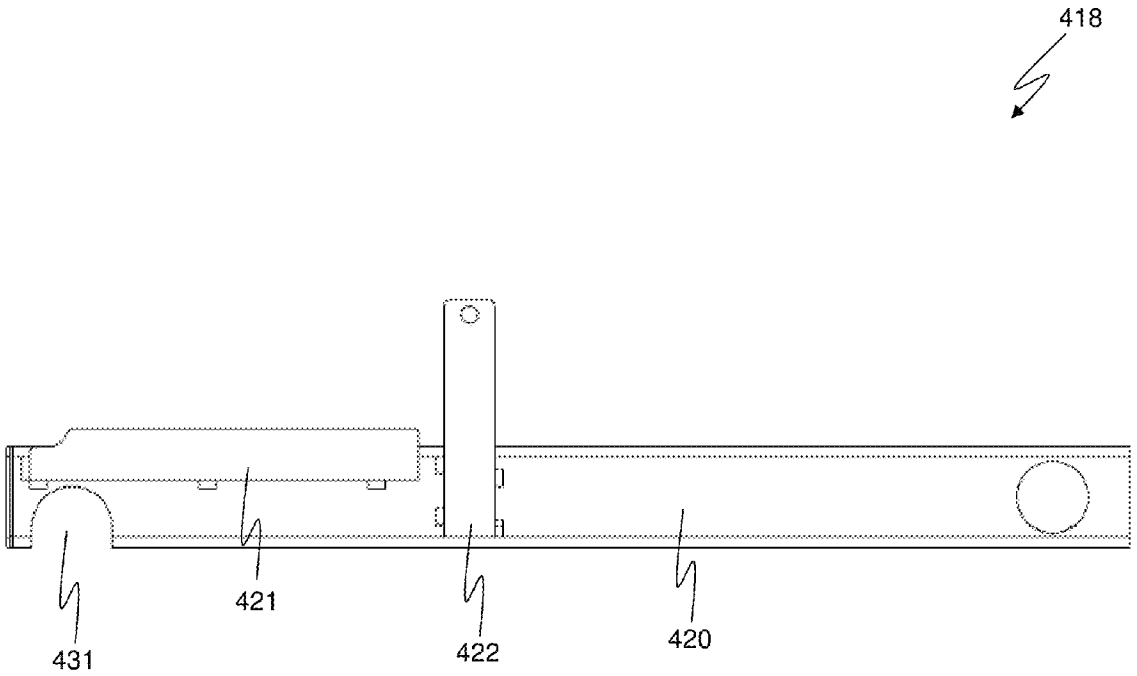
FIG. 15D is a side view of a barbell support of FIG. 15C.
Figure 15E:
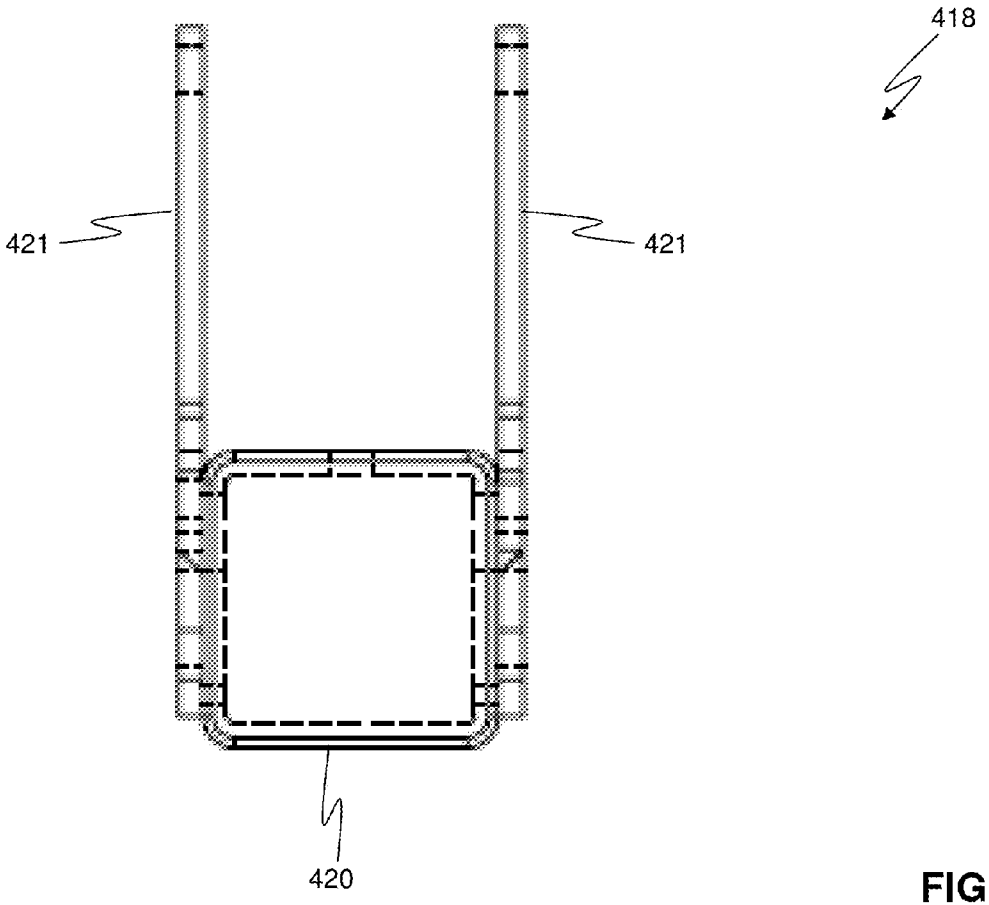
FIG. 15E is a front view of a barbell support of FIG. 15C.

It should be appreciated that as with other embodiments, an interface surface (or the surface of at least one of the barbell support shaft 420 and the dumbbell support shaft 434) between the barbell support shaft 420 and the dumbbell support shaft 434 may be a low friction surface (such as Ultra-High Molecular Weight Polyethylene UHMW) so that the dumbbell support shaft 434 can easily slide between an extended configuration and a retracted configuration may be provided. Additionally, it is contemplated that the barbell support shaft 420 may also include a pair of dumbbell support shaft side guides 421 as shown in FIG. 15C, FIG. 15D and FIG. 15E, where the dumbbell support shaft side guides 421 are securely attached to the sides of the barbell support shaft 420 to help guide the dumbbell support shaft 434 when the dumbbell support shaft 434 is being configured between the extended configuration and the retracted configuration. It should be appreciated that the dumbbell support shaft side guides 421 may be securely connected to the barbell support shaft 420 via any device or method suitable to the desired end purpose, such as via a weld, screws, pins, etc.

Moreover, it is contemplated that in another embodiment, a raised surface or lip may be included on the top surface of the barbell support shaft 420 (or bottom surface of the dumbbell support shaft 434) so that when dumbbells are located within the dumbbell support tray 432, the dumbbell support shaft 434 can tilt thereby locating the anchoring pin 428 within the pin cavity 438. When the barbell support shaft 420 is associated with a barbell 106, the barbell support shaft 420 rests on the barbell 106 such that the barbell 106 is contained within the barbell support shaft cavity 431. It should be appreciated that this raised surface may be integrated with the top of the barbell support shaft 420 (or bottom surface of the dumbbell support shaft 434) or the raised surface may be attached to the top surface of the barbell support shaft 420 (or bottom surface of the dumbbell support shaft 434).

Figure 16A:
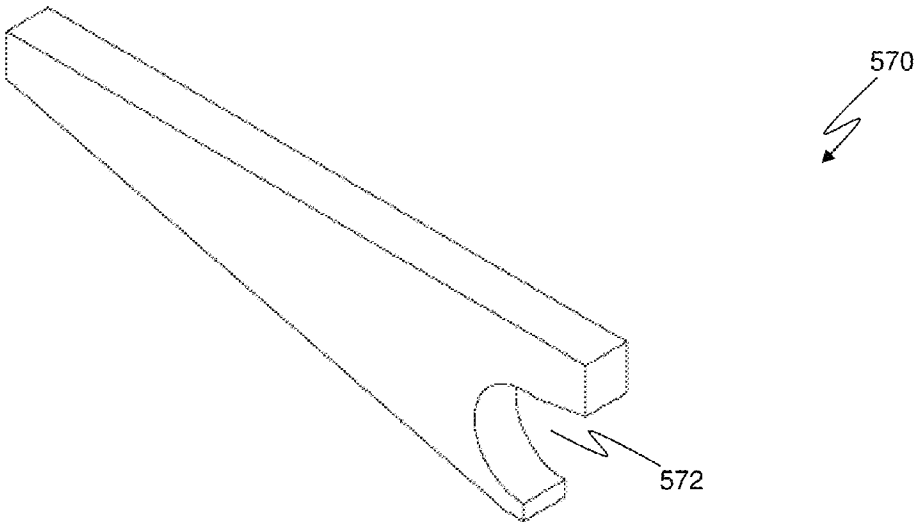
FIG. 16A is a top down side isometric view of the barbell cradle, in accordance with one embodiment of the invention.
Figure 16B:
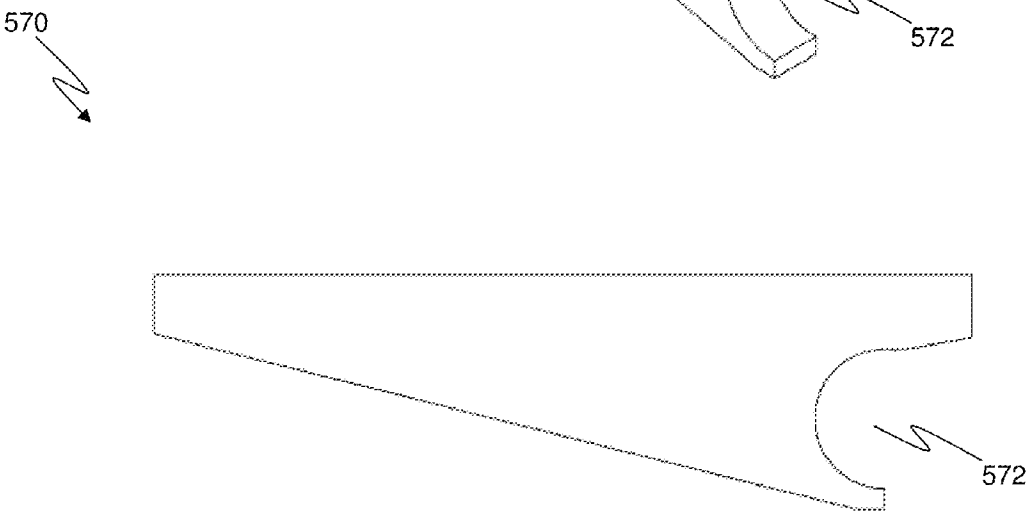
FIG. 16B is a side view of the barbell cradle of FIG. 16A.
Figure 16C:
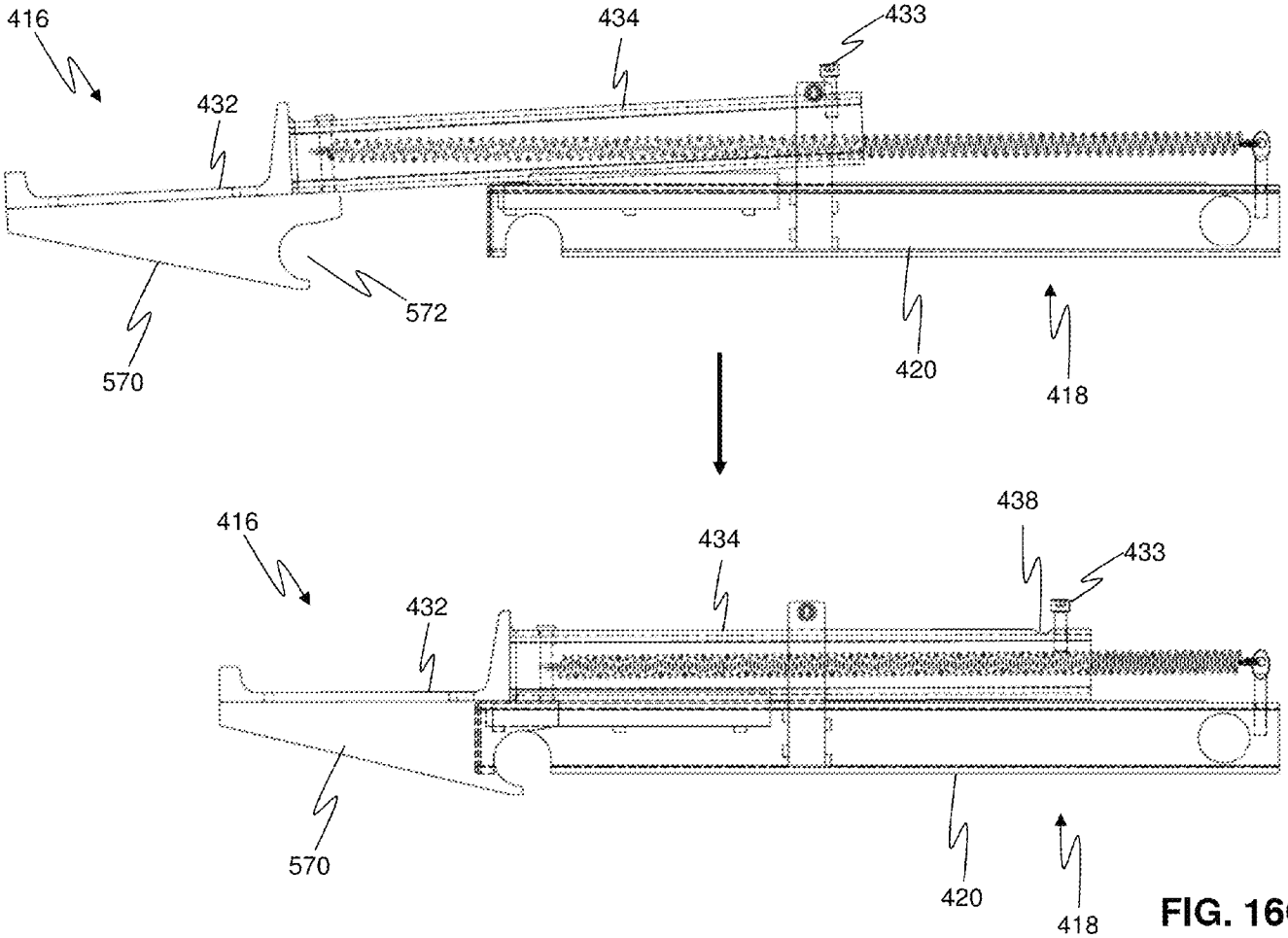
FIG. 16C a side view of the barbell cradle of FIG. 16A associated with a dumbbell support, in accordance with one embodiment of the invention.
Figures 16D, 16E, 16F:
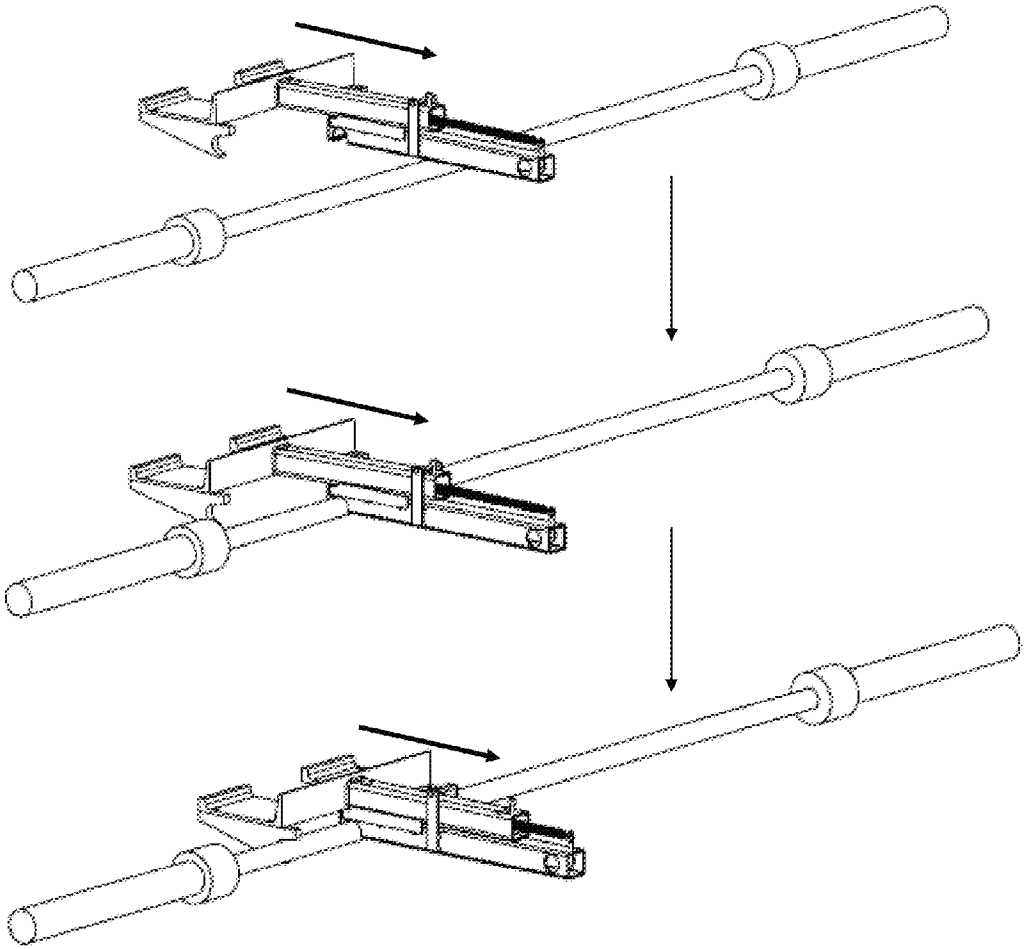
FIG. 16D a side perspective view of the barbell cradle of FIG. 16A associated with a dumbbell support, a barbell support and a barbell, in accordance with one embodiment of the invention.
FIG. 16E a side perspective view of the barbell cradle of FIG. 16A associated with a dumbbell support, a barbell support and a barbell, in accordance with one embodiment of the invention.
FIG. 16F a side perspective view of the barbell cradle of FIG. 16A associated with a dumbbell support, a barbell support and a barbell, in accordance with one embodiment of the invention.

Furthermore, referring to FIG. 16A, FIG. 16B and FIG. 16C, It should be appreciated that the dumbbell support 416 may also include a barbell cradle 570 having a barbell cradle cavity 572 which is configured to interact with a barbell 106 (or front anchor). One embodiment is shown where the barbell cradle 570 is securely (and removably, if desired) attached to the dumbbell support tray 432 and/or dumbbell support shaft 434 and located such that when the dumbbell support 416 is configured in the retracted configuration, the barbell 106 is located in the barbell cradle 570. This is illustrated in FIG. 16D, FIG. 16E and FIG. 16F, which shows the barbell support 416 being configured from the extended configuration (FIG. 16D) into the retracted configuration 16F.

Figure 17A:
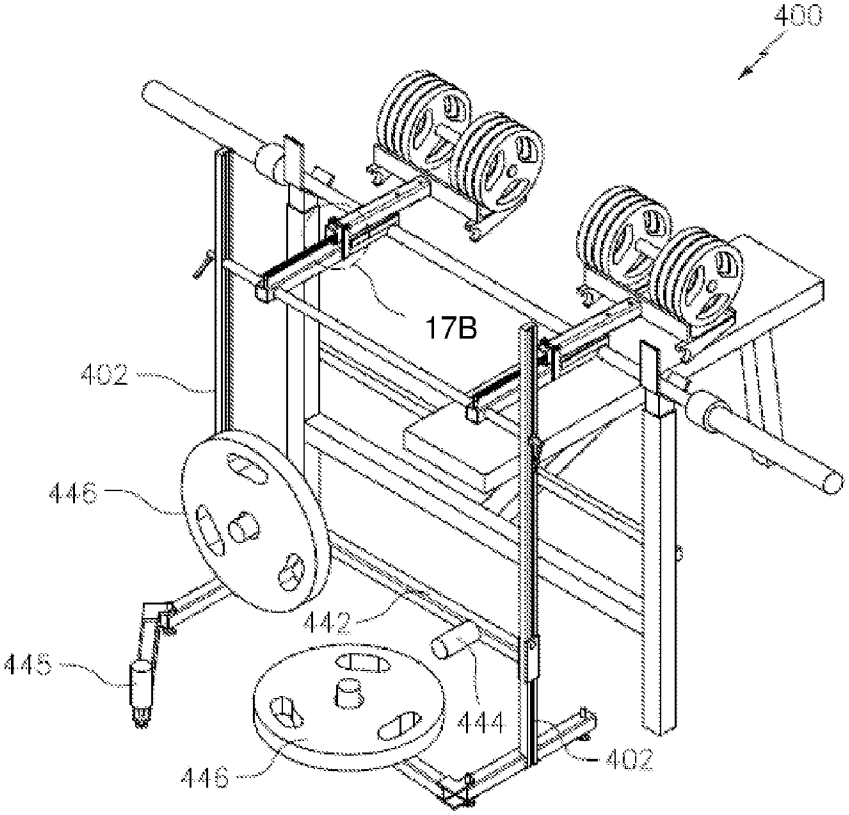
FIG. 17A is a top down rear side isometric view of the portable retractable dumbbell support system of FIG. 12.
Figure 17B:
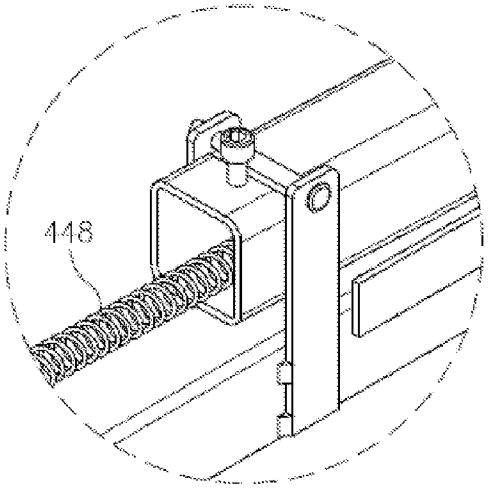
FIG. 17B is an enlarged section view of the biasing means for the portable retractable dumbbell support system of FIG. 12.

Referring to FIG. 12, FIG. 17A and FIG. 17B, the dumbbell support system 400 may also include a weight support article 442 which is securely and movably attached to and located between the first support structure 402 and the second support structure 406. The weight support article 442 may include one or more plate structures or posts 444 configured to hold weight plates 446 that may be used as a counterbalance to the weight put on the dumbbell support trays 416. Additionally, the first support base 404 and/or the second support base 408 may also include one or more base plate structures 445 for holding weight plates 446 that may be used as a counterbalance to the weight put on the dumbbell support trays 432. It should be appreciated that at least one of the one or more base plate structures 445 may be movably (i.e. rotatably or extendingly) attached to the first support base 404 and/or the second support base 408 for locating the weight plates 446 in various configurations (i.e. locations) relative to the first support base 404 and/or the second support base 408. This configurability allows the dumbbell support system 400 to be used in areas with limited space.

It is contemplated that a biasing element 448 having a first biasing element end and second biasing element end may be included, wherein the first biasing element end is connected to the first biasing member connector 430 and the second biasing element end is connected to the second biasing member connector 436. It should be appreciated that the biasing element 448 operates to bias the dumbbell support 416 into the retracted configuration such that when the dumbbells are lifted off of the dumbbell support trays 432, the dumbbell support shaft 434 is configured from an extended configuration into a retracted configuration in a similar manner to that of the counterweight plate 242 in previous embodiments. It should be appreciated that the biasing member 448 may be any type of biasing member suitable to the desired end purpose, such as a spring or resilient strap. Moreover, it should be appreciated that the biasing member 448 has an elasticity force of between about 5 lbs and about 20 lbs, preferably 7 lbs. However, the elasticity force of the biasing member 448 may be any force level suitable to the desired end purpose and/or that is appropriate for the weight of the dumbbells.

Figure 18B:
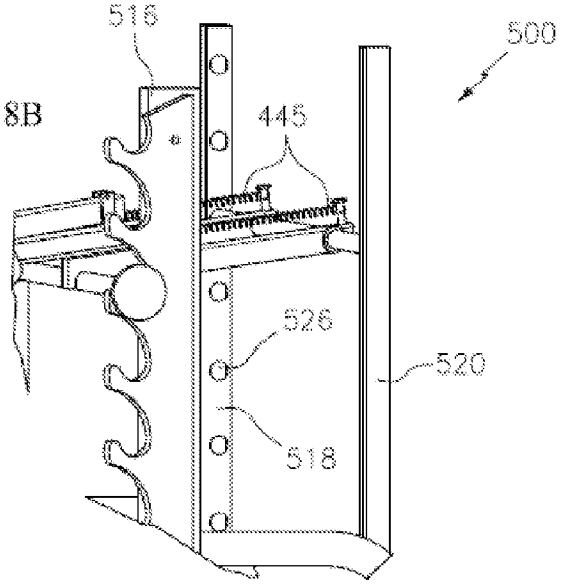
FIG. 18B is an enlarged section view of the biasing means for the standalone retractable dumbbell support system of FIG. 18A.
Figure 18A:
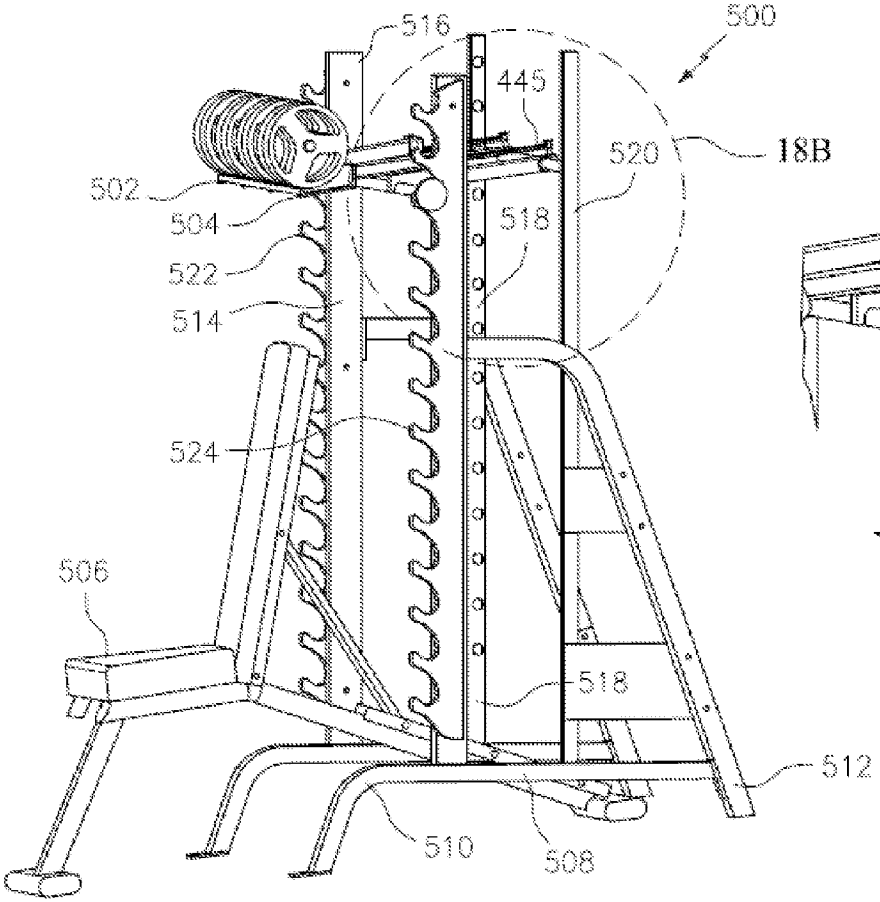
FIG. 18A is a side isometric view of a standalone retractable dumbbell support system with a biasing spring, in accordance with still yet another embodiment of the invention.
Figure 18C:
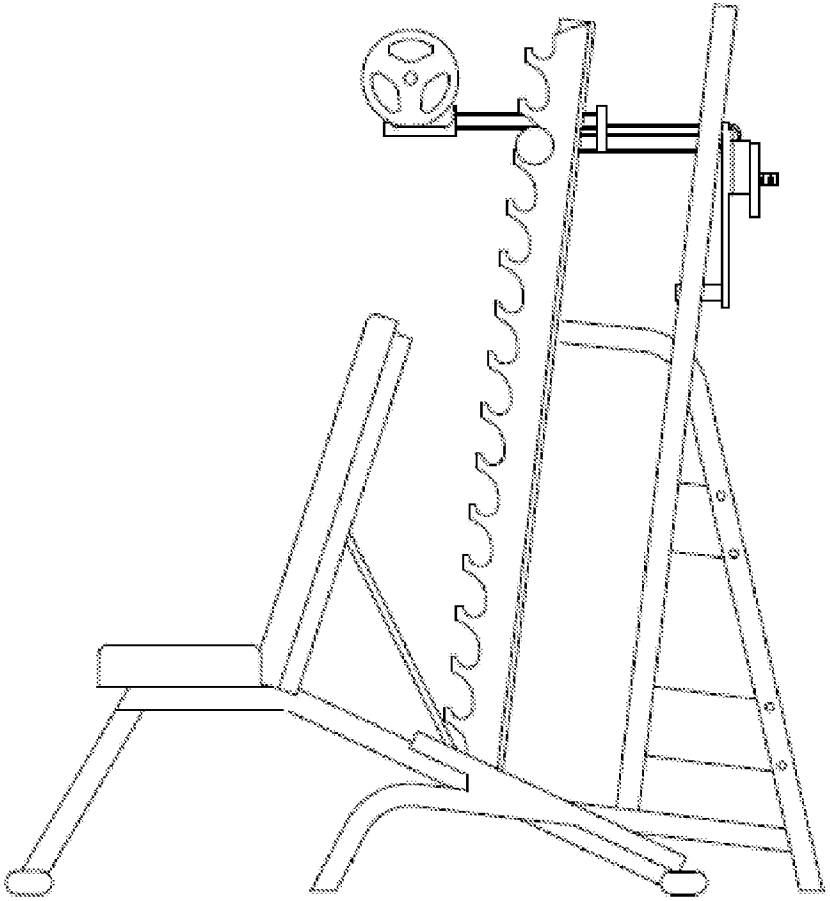
FIG. 18C is a side isometric view of the standalone retractable dumbbell support system of FIG. 18A with a biasing weight, in accordance with still yet another embodiment of the invention.

Referring to FIG. 18A and FIG. 18B, a weight bench with an dumbbell support system 500 is shown, in accordance with yet another embodiment of the invention. The dumbbell support system 500 may include a first dumbbell support assembly 502 and a second dumbbell support assembly 504, wherein each of the first dumbbell support assembly 502 and second dumbbell support assembly 504 may include a biasing element 445 and is similar (and operates similar) to that discussed hereinabove with the several embodiments. Moreover, it is contemplated that a biasing weight may be used as well, as shown in FIG. 18C. It should be appreciated that in additional embodiments, the dumbbell support system 500 may be integrated with or attached to an existing weight bench (such as a Body Solid Bench Model GPR370) via any method or device suitable to the desired end purpose, such as screws, bolts, welds, etc.

It should be appreciated that in this embodiment, the dumbbell support system 500 may include a weight bench 506 having a frame that may be configured such that a counterweight is not needed to balance the additional weight that is added to the bench by the dumbbells. As such, the weight bench 506 may include support legs 508 having a front support leg portion 510 and a rear support leg portion 512, wherein the front support leg portion 510 extends forward sufficiently to counter the forward weight added by the dumbbells. Also, it is contemplated that, if desired, a feature that would allow a user to adjust the length of the front support leg portion 510 to accommodate heavier dumbbells may be provided. As such, for heavier dumbbells, the front support leg portion 510 could be extended outwardly. It should be appreciated that the rear support leg portion 512 may also have this type of extension feature if desired. This type of adjustment may be accomplished via a pin/hole type of configuration.

Figure 19A:
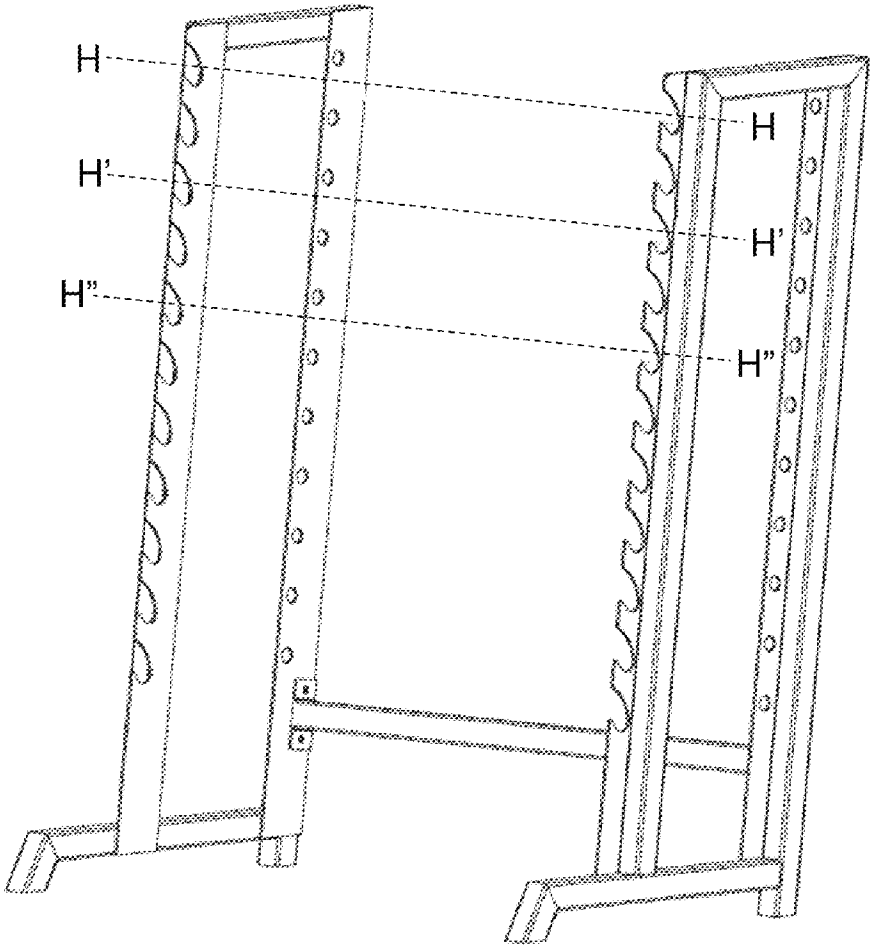
FIG. 19A is a front side isometric view of the standalone retractable dumbbell support system of FIG. 18A.
Figure 19B:
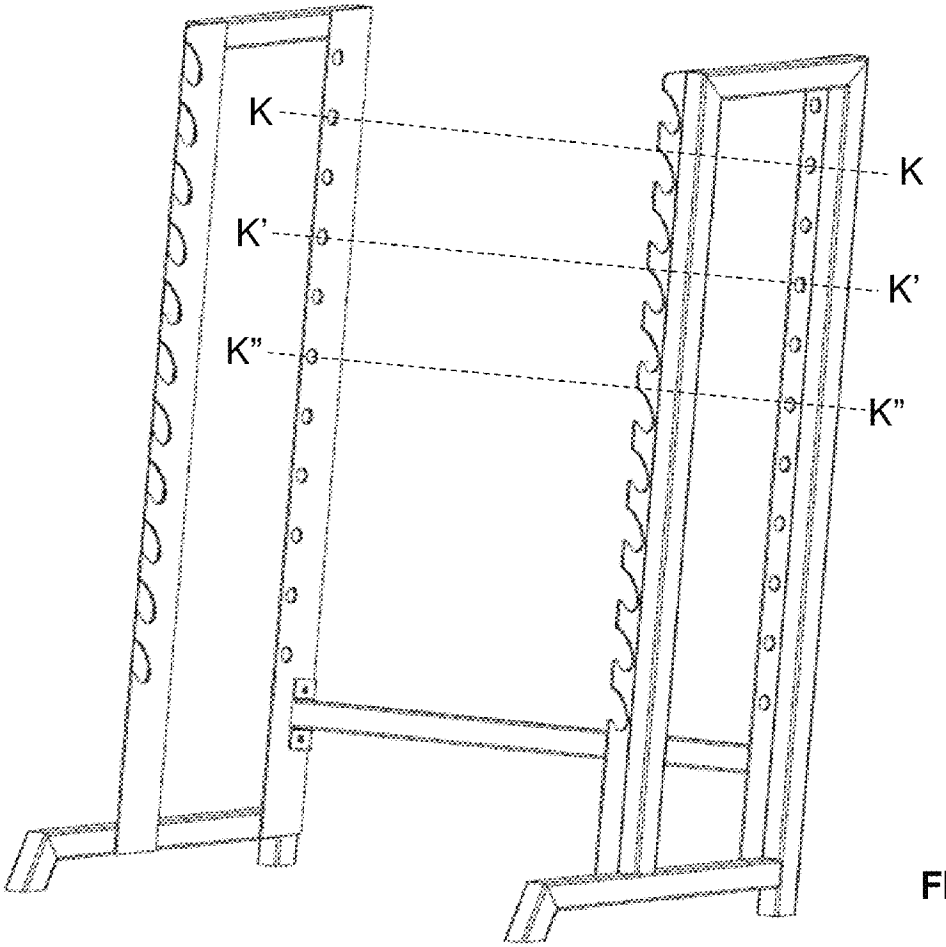
FIG. 19B is a front side isometric view of the standalone retractable dumbbell support system of FIG. 18A.

The weight bench 506 includes a first front support structure 514, a second front support structure 516, a first rear support structure 518 and a second rear support structure 520. The first front support structure 514 includes a first notched portion 522 which extends at least partially along the height of the first front support structure 514 and the second front support structure 516 includes a second notched portion 524 which extends at least partially along the height of the second front support structure 516. Each of the first and second notched portions 522, 524 include a plurality of notch pairs that are aligned with each other in a horizontal plane such that when a weight bar is located within a notch of a notch pair of the first notched portion 522 and a corresponding notch of the notch pair of the second notched portion 524, the weight bar is substantially horizontal. This is illustrated in FIG. 19A which shows different imaginary horizontal planes H, H' and H".

Furthermore, the first rear support structure 518 includes a plurality of first rear support structure openings 526, wherein the plurality of first rear support structure openings 526 are distributed along the height of the first rear support structure 518. Additionally, the second rear support structure 520 includes a plurality of second rear support structure openings (not shown), wherein the plurality of second rear support structure openings (not shown) are distributed along the height of the second rear support structure 520. The plurality of first rear support structure openings 526 and plurality of second rear support structure openings (not shown) are located such that they are aligned with each other to form opening pairs. For example, when one end of an anchor bar is located within one opening of an opening pair of the first rear support structure openings 526 and the other end of an anchor bar is located within the other opening of an opening pair of the second rear support structure openings 526, the anchor bar is substantially horizontal. This is illustrated in FIG. 19A which shows different imaginary horizontal planes K, K' and K".

Figure 20A:
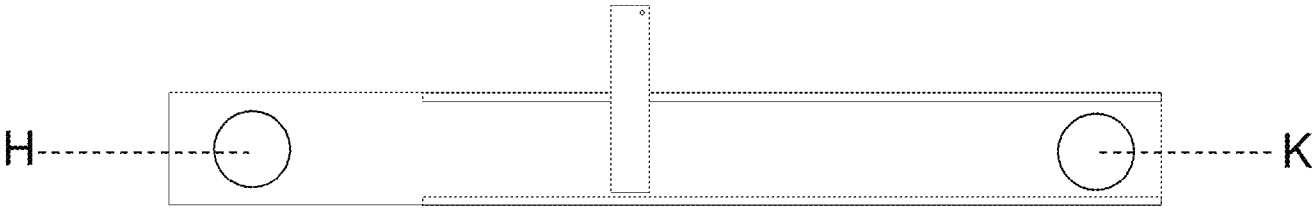
FIG. 20A is a side view of a barbell support, in accordance with one embodiment of the invention.
Figure 20B:
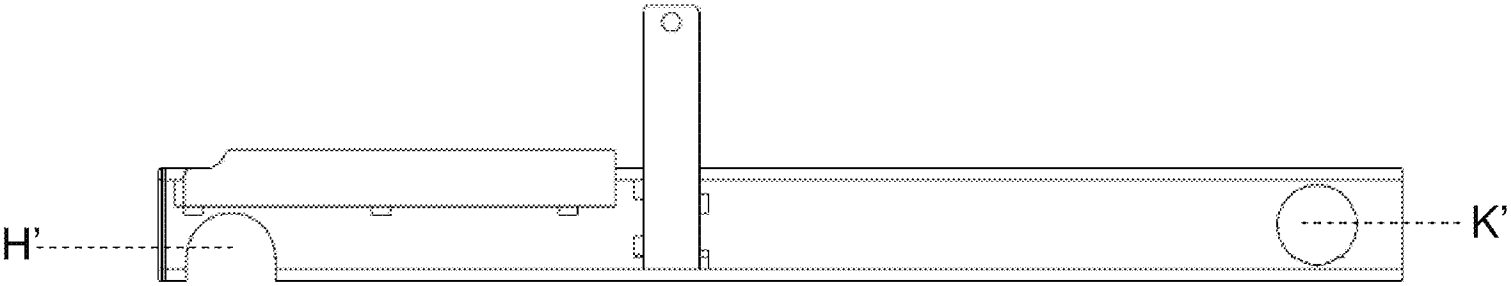
FIG. 20B is a side view of a barbell support, in accordance with another embodiment of the invention.

Additionally, each of the notch pairs (of the first and second front support structures 514, 516) are positioned relative to each of the opening pairs (of the first and second rear support structures 518, 520) such that if a weight bar is located within a notch pair (of the first and second front support structures 514, 516) and an anchor bar is located within a corresponding opening pair (of the first and second rear support structures 518, 520), and a first support system is associated with the weight bar and the anchor bar, the first support system will be substantially horizontal (i.e. level within a margin of error). Thus, in some embodiments, the weight bar and anchor bar may be substantially within the same horizontal plane (as shown in FIG. 20A where the imaginary horizontal planes H and K lie in same plane) and in other embodiments the weight bar and anchor bar are offset and thus located in different horizontal planes (as shown in FIG. 20B where the imaginary horizontal planes H' and K' are offset from each other).

Figure 21A:
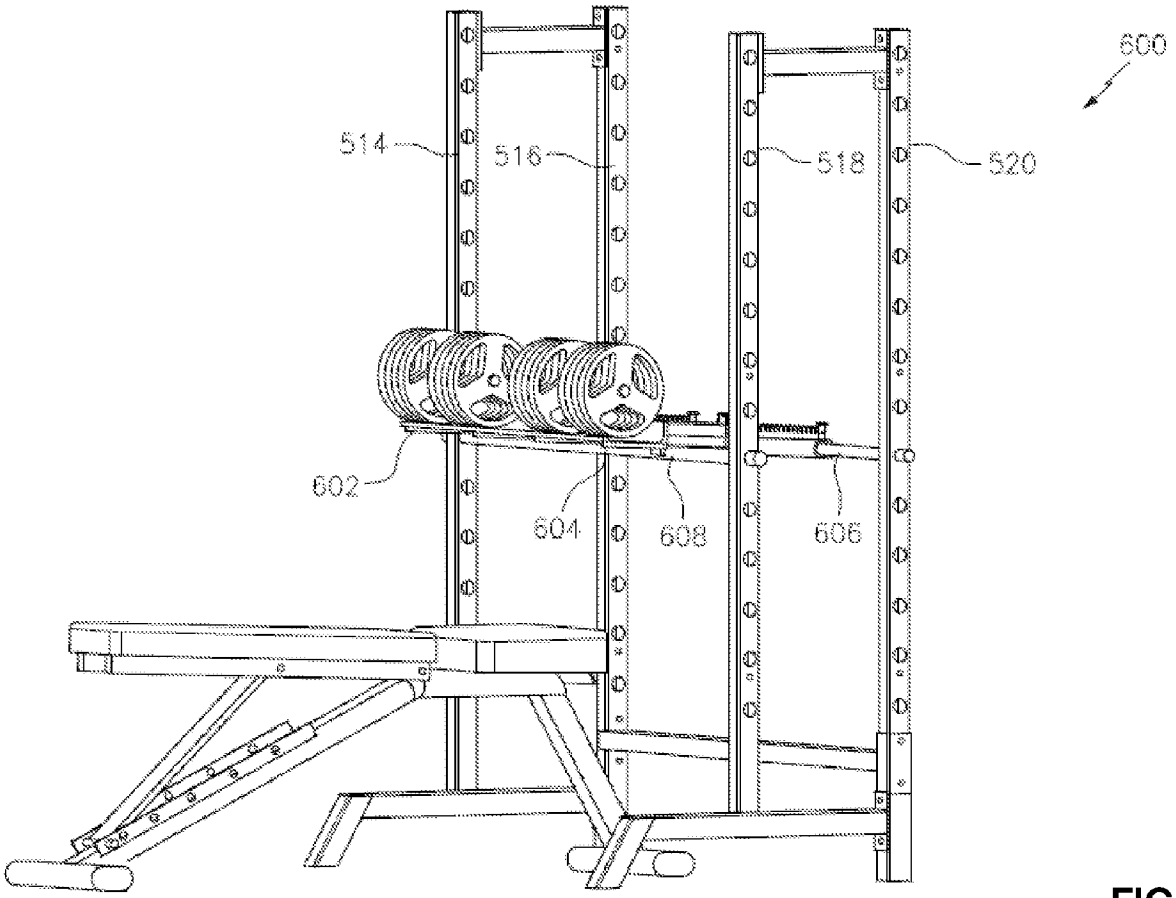
FIG. 21A is a side isometric view of a standalone retractable dumbbell support system, in accordance with still yet another embodiment of the invention.
Figure 21B:
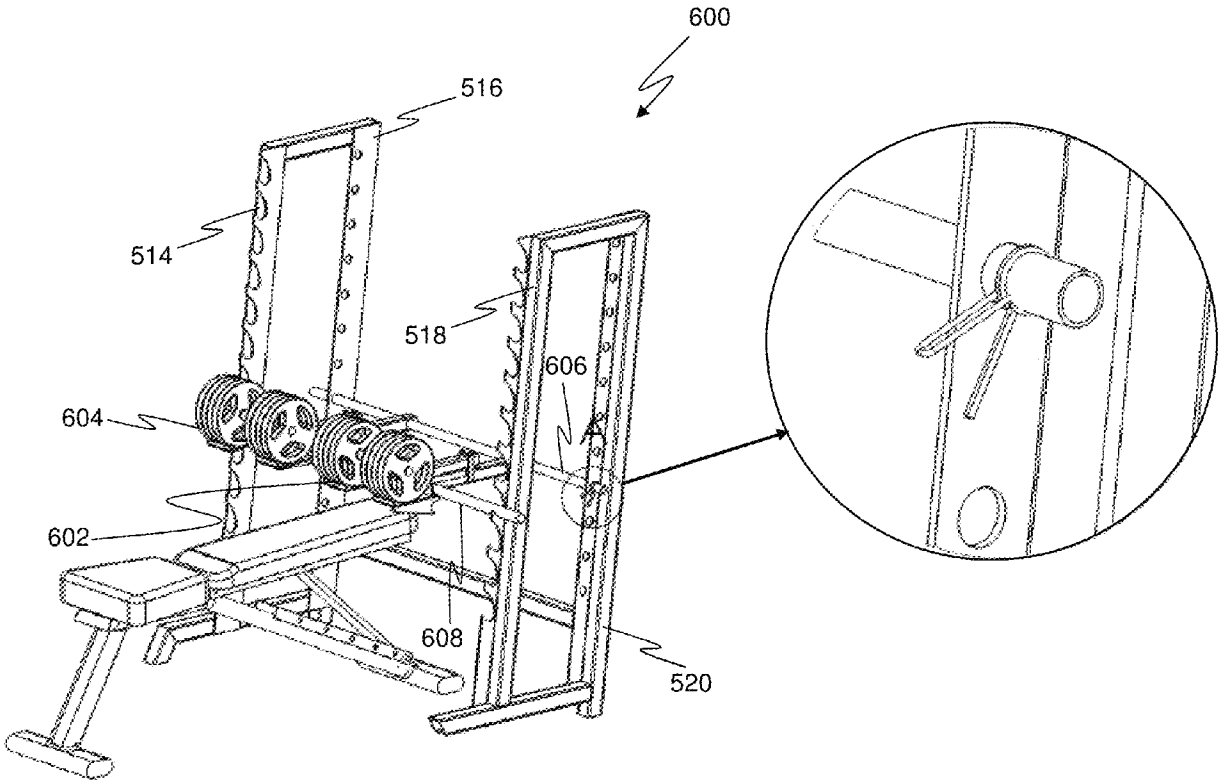
FIG. 21B is a side isometric view of a standalone retractable dumbbell support system, in accordance with still yet another embodiment of the invention.
Figure 22:
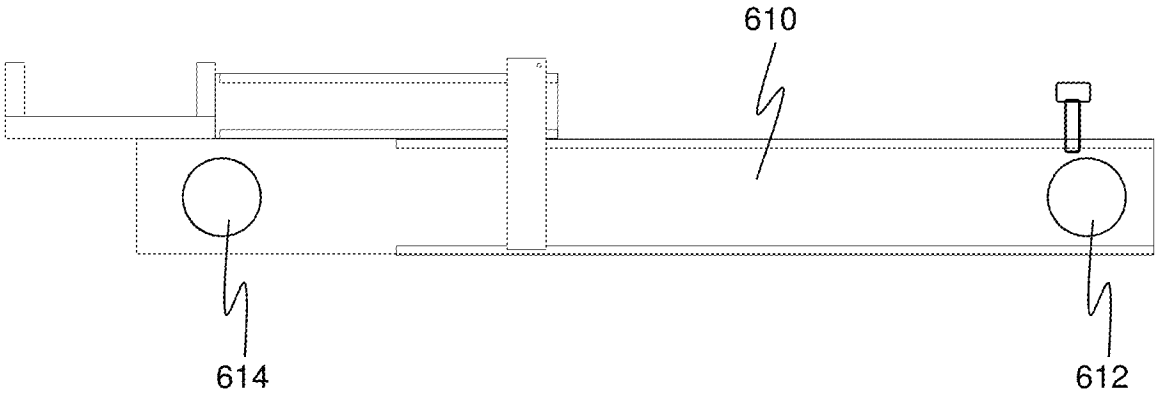
FIG. 22 is a side view of the barbell support for use with a retractable dumbbell support system, in accordance with still yet another embodiment of the invention.
Figure 23A:
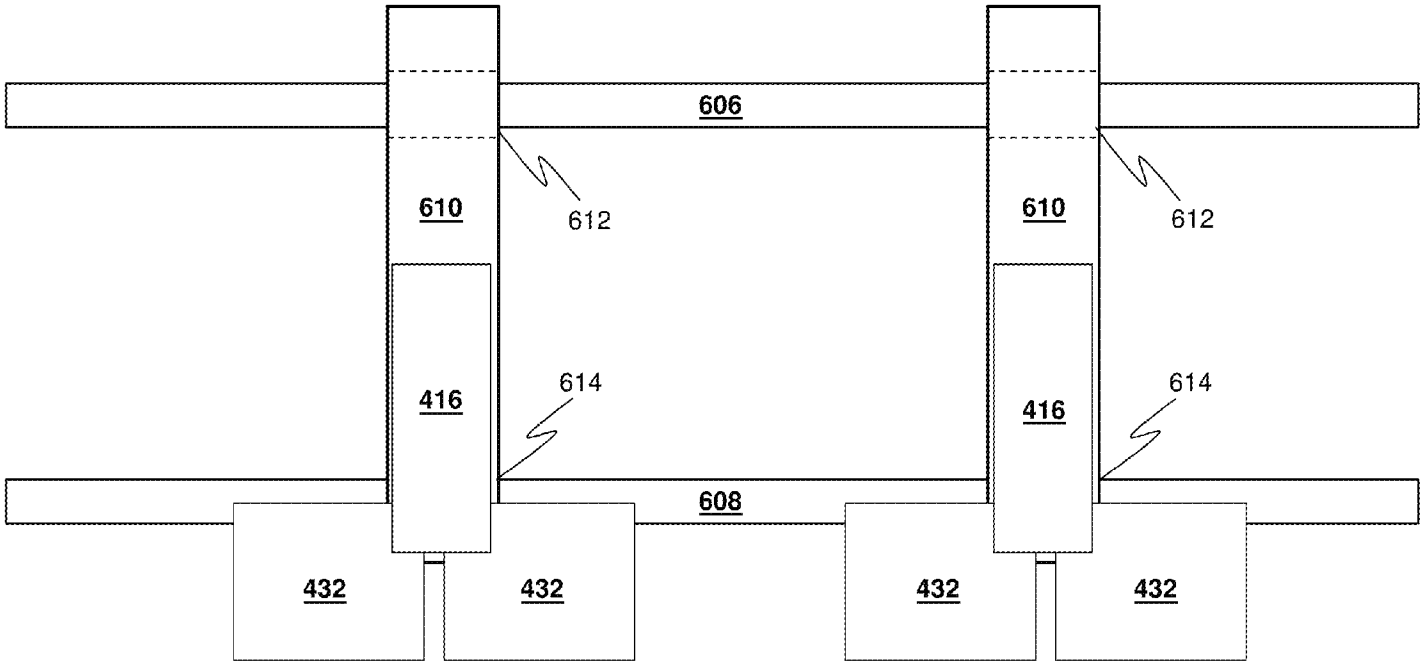
FIG. 23A is a top down view of the barbell support of FIG. 22 associated with the front and rear anchor bars of a dumbbell support system.

Referring to FIG. 21, in still yet another embodiment, it should be appreciated that the dumbbell support system 600 may include a first dumbbell support assembly 602 and a second dumbbell support assembly 604, wherein each include a dumbbell support 416 and a barbell support 418, as discussed hereinabove with regards to the other embodiments. In this embodiment, the barbell support 418 may be configured to be associated to a rear anchor bar 606 or the rear anchor bar 606 may be an integral part of the barbell support 418. Thus, when the rear anchor bar 606 is located within a corresponding opening pair (of the first and second rear support structures 518, 520), the barbell support 418 is securely attached to the dumbbell support system 600. It should be appreciated that the anchor bar 606 may simply rest in the openings of the first and second rear support structures 518, 520 (See FIG. 21A) or the anchor bar 606 may be secured in place via any method or device suitable to the desired end purpose, such as for example a spring retainer (See FIG. 21B). Additionally, it is contemplated that the dumbbell support 416 may associate with a weight bar or a front anchor bar 608 as discussed hereinabove with regards to the other embodiments or the dumbbell support 416 may associate with the front anchor bar 608 in a manner similar to the barbell support 418 and rear anchor bar 606. Referring to FIG. 22 and FIG. 23A, one way to accomplish this would may be to have a barbell support shaft 610 that includes a barbell support shaft rear opening 612 (and may have a barbell support shaft front opening 614) which is configured to receive and contain the rear anchor bar 606 (and front anchor bar 608).

Figure 23B:
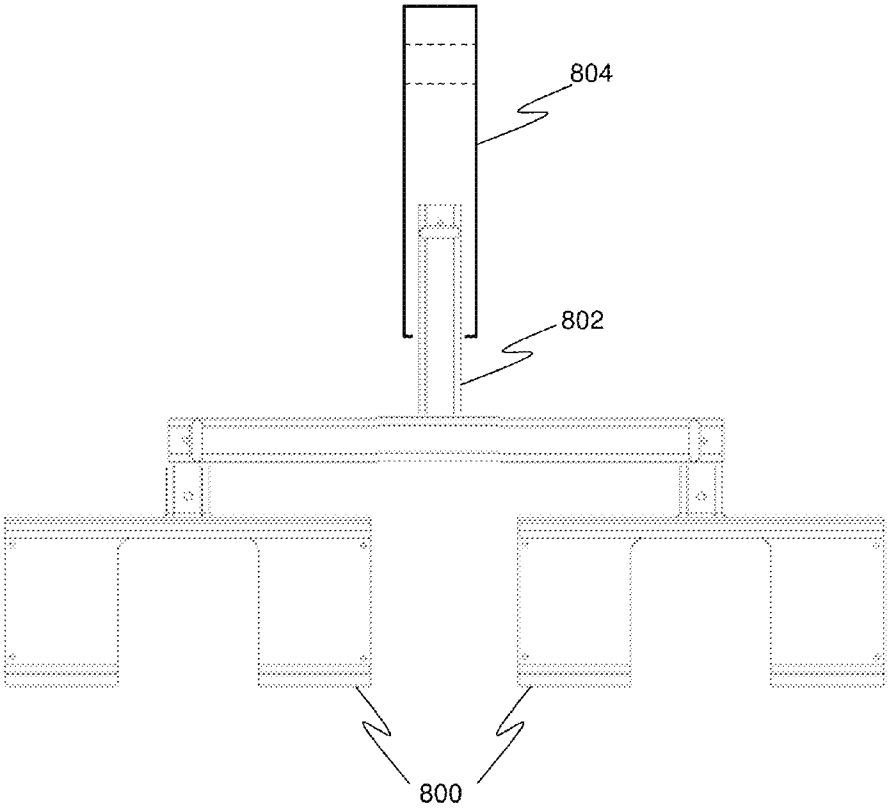
FIG. 23B is a top down view of a dumbbell support associated with a barbell support, where the dumbbell support is configured to hold two dumbbells, in accordance with still yet another embodiment of the invention.
Figure 24:
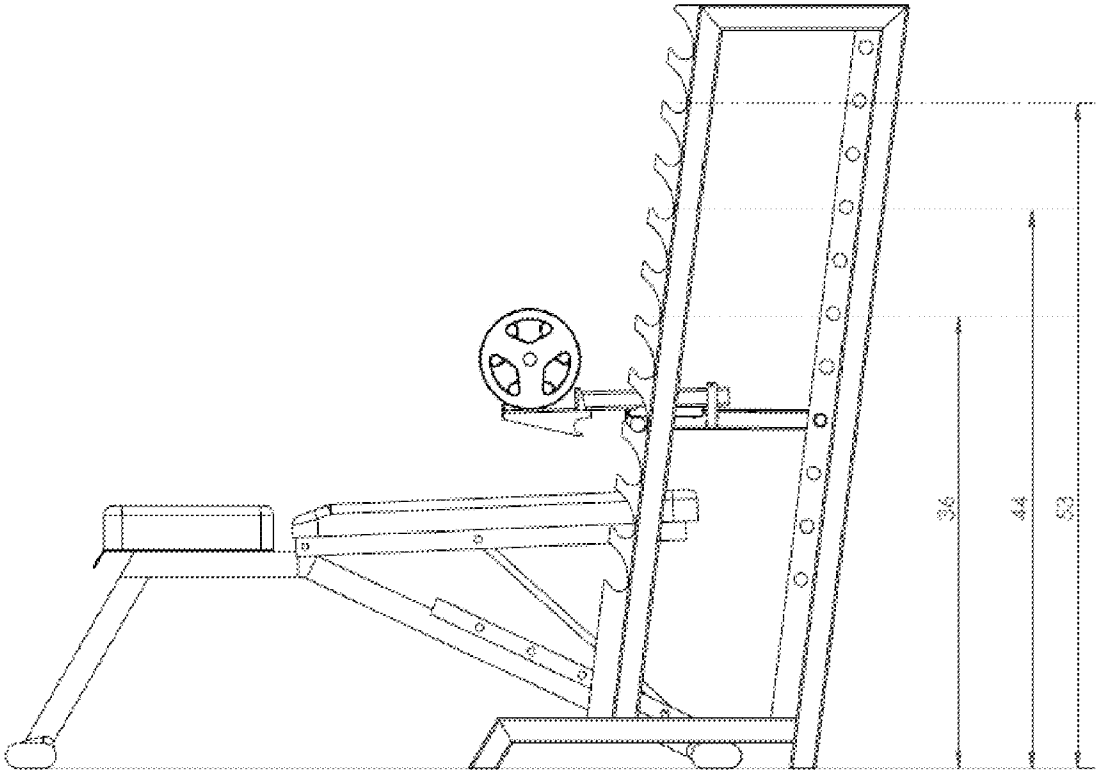
FIG. 24 is a side view of the retractable dumbbell system showing some dimensions (in inches), in accordance with one embodiment of the invention.
Figure 25:
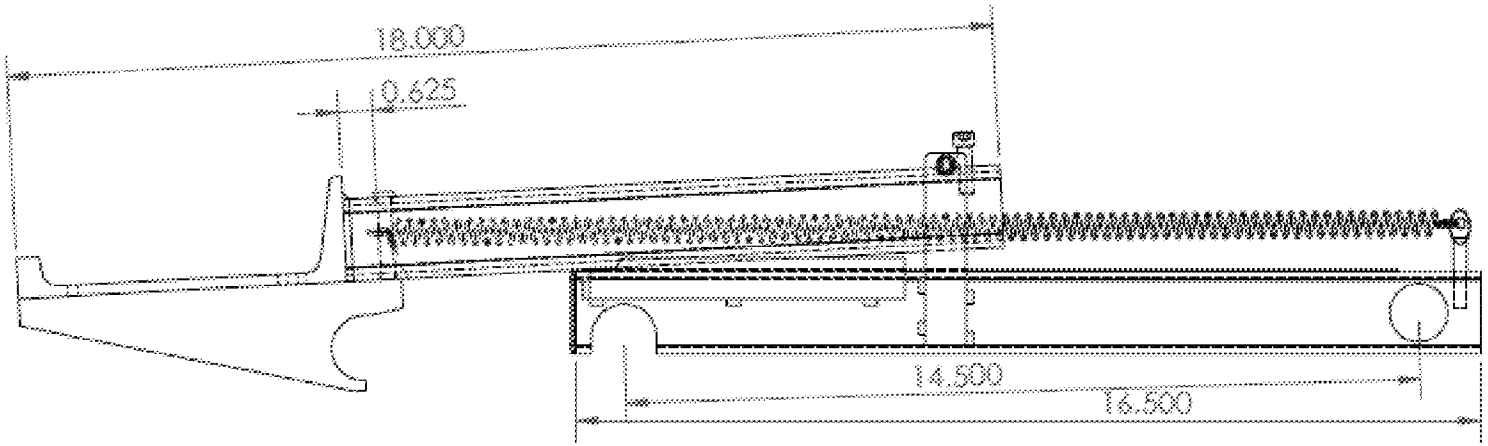
FIG. 25 is a side view of a dumbbell support associated with a barbell support in the extended configuration showing some dimensions (in inches), in accordance with one embodiment of the invention.
Figure 26:
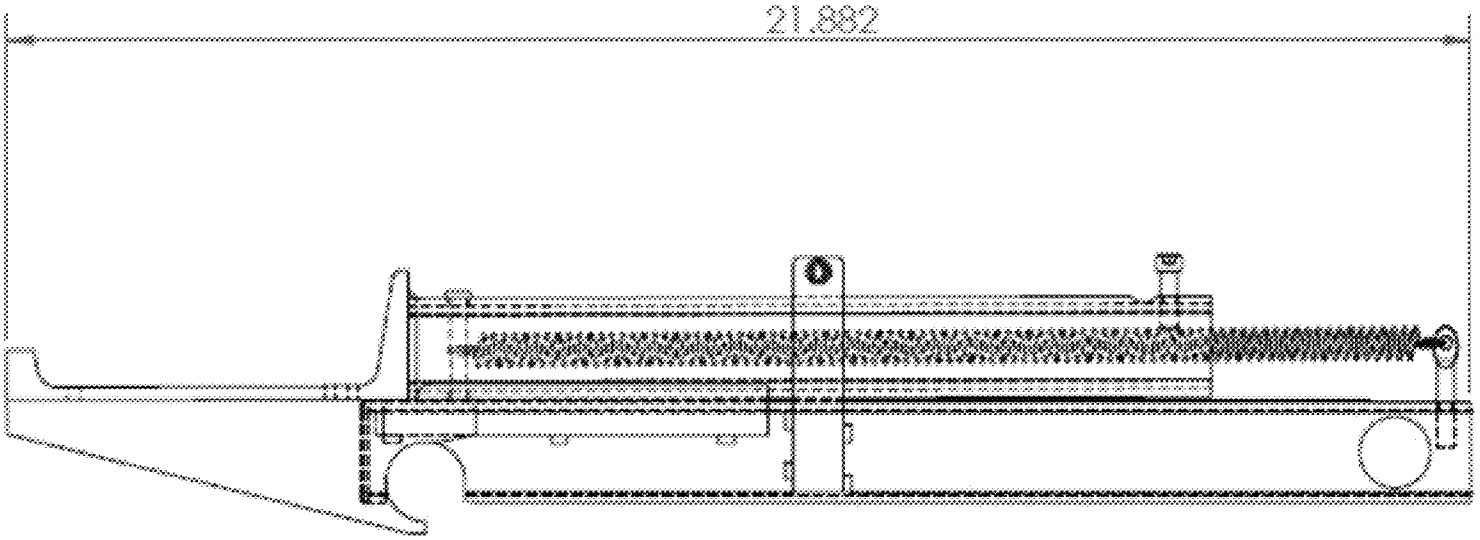
FIG. 26 is a side view of a dumbbell support associated with a barbell support in the retracted configuration showing some dimensions (in inches), in accordance with one embodiment of the invention.
Figure 27:
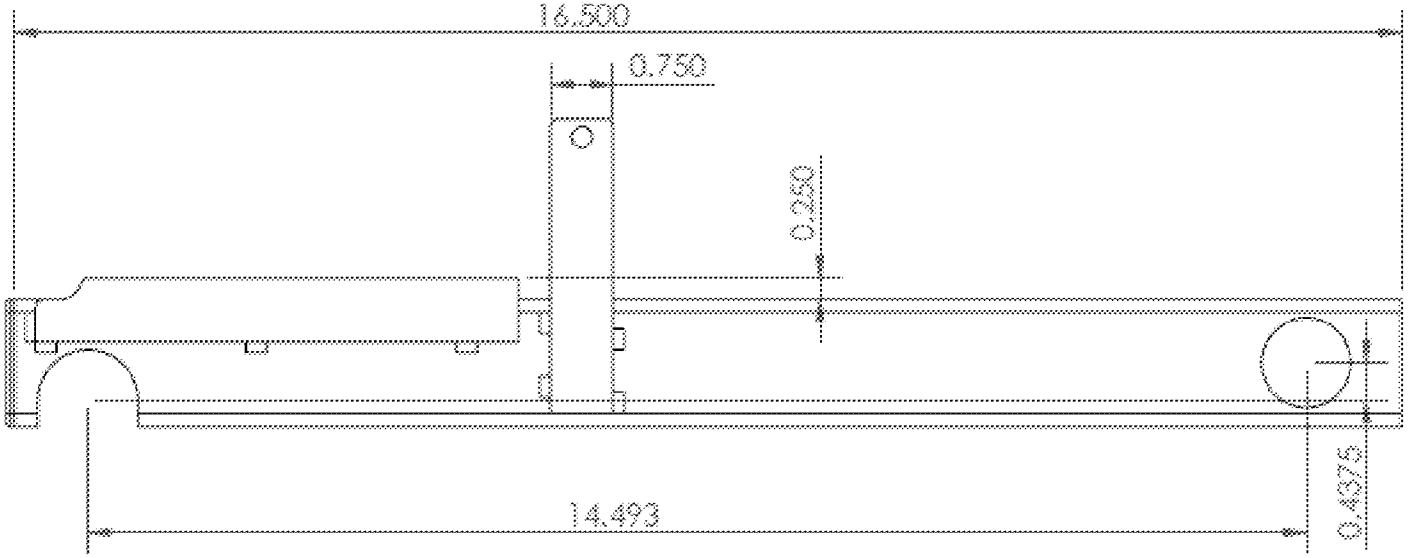
FIG. 27 is a side view of the barbell support showing some dimensions (in inches), in accordance with one embodiment of the invention.
Figure 28:
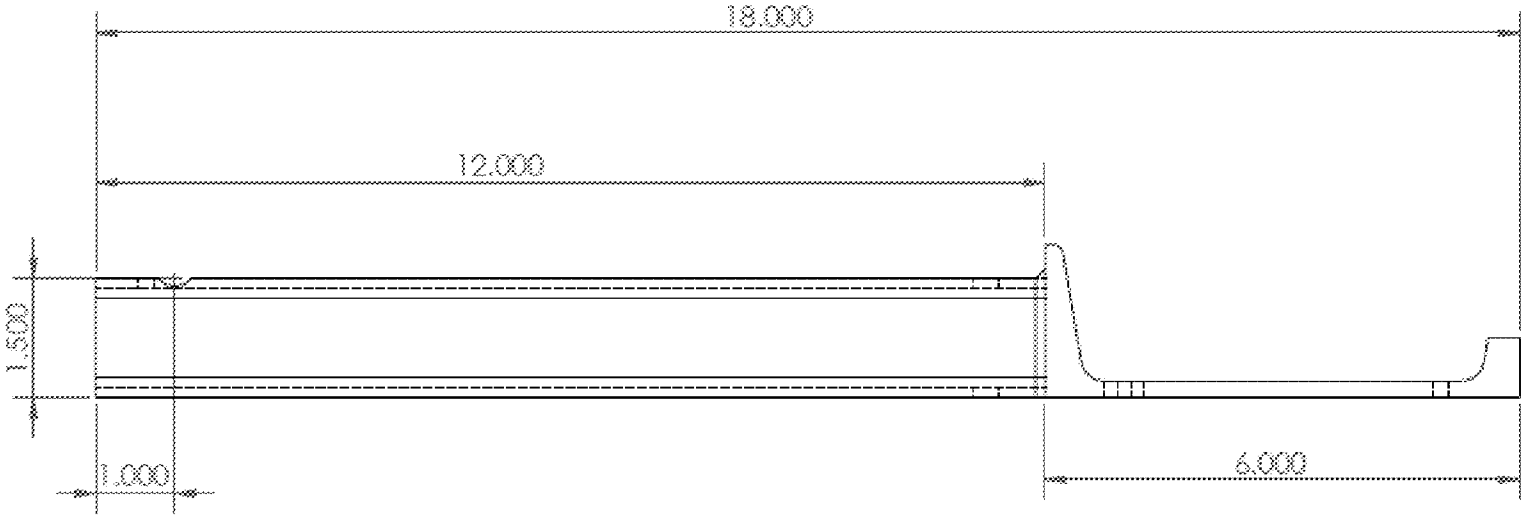
FIG. 28 is a side view of the dumbbell support showing some dimensions (in inches), in accordance with one embodiment of the invention.
Figure 29:
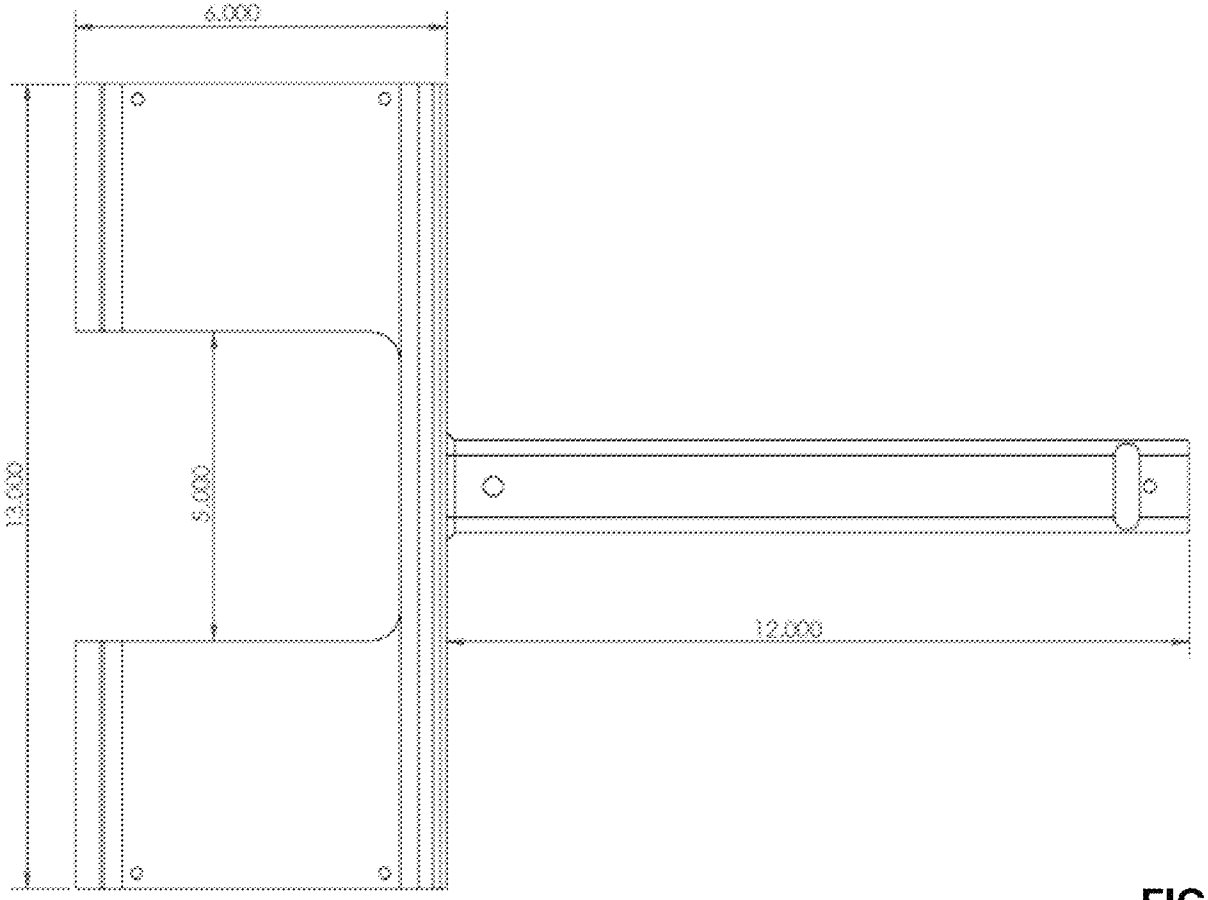
FIG. 29 is a top down view of the dumbbell support showing some dimensions (in inches), in accordance with one embodiment of the invention.
Figure 30:
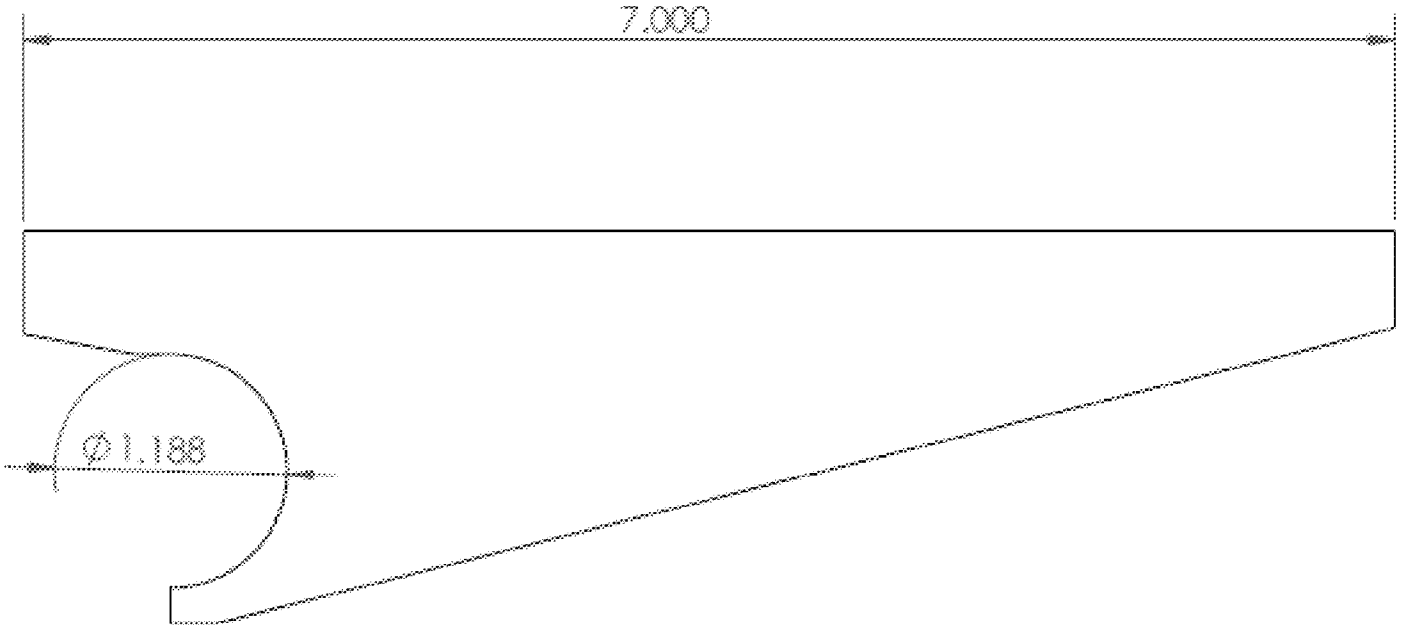
FIG. 30 is a side view of the barbell cradle showing some dimensions (in inches), in accordance with one embodiment of the invention.

It should be appreciated that additional embodiments of the invention are contemplated wherein the invention may include only one barbell support and dumbbell support. Referring to FIG. 23B, in such an embodiment the dumbbell support tray 800 may be configured to hold two dumbbells that are spaced apart to allow a user to grab and lift the dumbbells. The dumbbell support shaft 802 would configurably associate with the barbell support shaft 804 as discussed hereinabove with regards to the other embodiments of the invention.

Referring to FIG. 24-FIG. 30, components of the invention are shown with dimensions (in inches), in accordance with one embodiment of the invention. It is contemplated that other dimensions and/or sizes are within the scope of the invention and may be used, based on the desired size of the retractable dumbbell support system. It should be appreciated that the components of the invention as disclosed herein may be constructed from any material capable of supporting heavy weights up to 1000 (or more) pounds and suitable to the desired end purpose, such as a composite material and/or a metal material (for example structural stainless steel).

Figure 31:
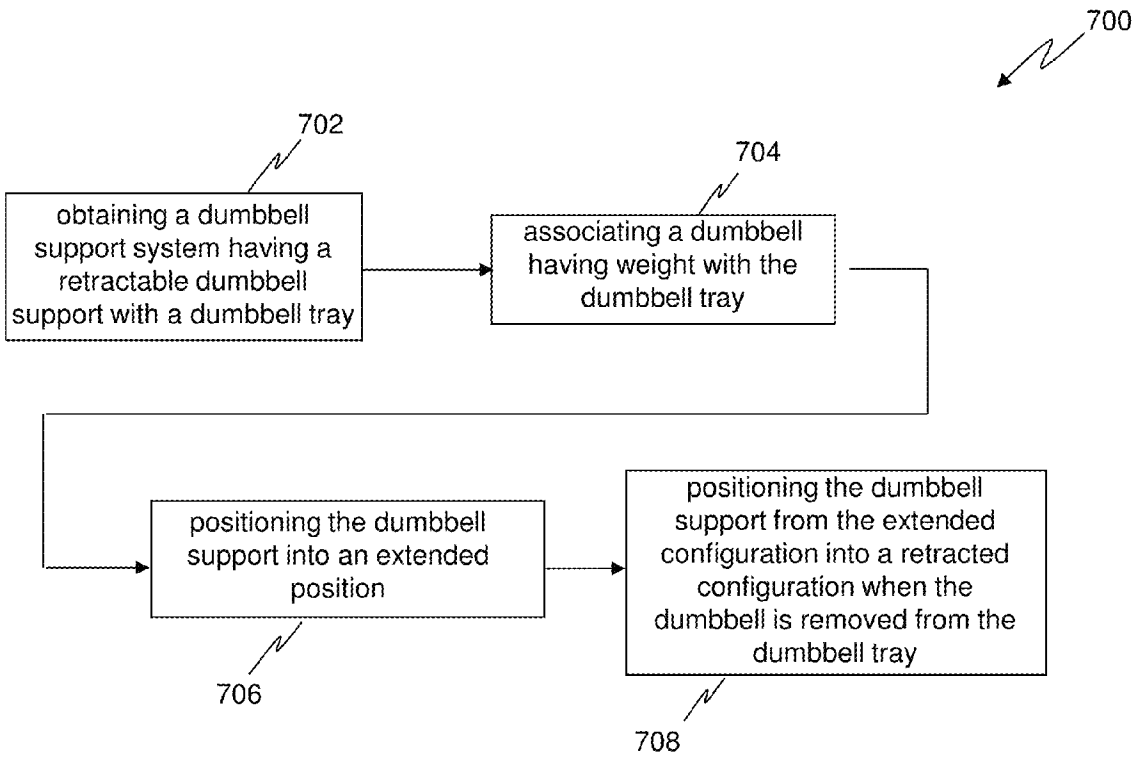
FIG. 31 is an operational block diagram illustrating one embodiment of a method for relocating dumbbells is shown, in accordance with one embodiment of the invention.

Moreover, referring to FIG. 31, an operational block diagram illustrating a method 700 for positioning dumbbells is shown and includes obtaining a dumbbell support system having a retractable dumbbell support with a dumbbell tray, as shown in operational block 702. Locating a dumbbell having weight on the dumbbell tray, as shown in operational block 704, and positioning the dumbbell support into an extended position, as shown in operational block 706. It should be appreciated that the weight on the dumbbell tray will cause the dumbbell support to stay in the extended position. When the dumbbell is removed from the dumbbell tray, positioning the dumbbell support from the extended configuration into a retracted configuration, as shown in operational block 708. It should be appreciated that the operations discussed above may be accomplished in any order as desired and thus the order above is only one embodiment. Moreover, it should be appreciated that although the invention discloses a dumbbell tray that adjusts between an extended configuration and a retracted configuration, it is contemplated that in other embodiments the dumbbell tray may rotate out of the way of the weight lifter. Thus, in such an embodiment, when the dumbbells are removed from the dumbbell tray, the dumbbell tray (or some or all of the dumbbell and/or barbell support) will rotate away from the weightlifter so that the weightlifter can lift the dumbbells without interference. Additionally, it is contemplated that the invention may be used with weight benches that are flat, inclined and/or declined.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A retractable dumbbell support article, comprising:
a support structure;
a biasing article;
a first system support; and
a second system support, wherein each of the first system support and second system support are associated with the support structure and includes,
a barbell support having a barbell support shaft and a dumbbell support shaft guide, wherein the dumbbell support shaft guide defines a guide cavity and includes an anchoring pin located within the guide cavity; and
a dumbbell support having a dumbbell support shaft and a dumbbell support tray, wherein the dumbbell support shaft includes a support body pin cavity configured to contain the anchoring pin and wherein the dumbbell support is movably associated with the barbell support, and
wherein the biasing article is connected to the dumbbell support to configure the dumbbell support between a first configuration and a second configuration and wherein when the dumbbell support is located in the first configuration and a dumbbell is located on the dumbbell support tray, the dumbbell is tilted such that the anchoring pin is located within the support body pin cavity.

2. The retractable dumbbell support system of claim 1, wherein the biasing article is at least one of a spring and a weight.

3. The retractable dumbbell support system of claim 1, wherein the biasing article is a spring and is further connected to the barbell support.

4. The retractable dumbbell support system of claim 1, wherein the biasing article is a retraction article movably associated with the support structure, wherein the retraction article is configured to include a weighted object.

5. The retractable dumbbell support system of claim 1, wherein the barbell support includes a barbell support shaft cavity configured to rest on and contain a barbell.

6. The retractable dumbbell support system of claim 1, wherein the barbell support further includes at least one dumbbell support shaft side guide.

7. The retractable dumbbell support system of claim 1, further comprising a barbell cradle having a barbell cradle cavity, wherein the barbell cradle cavity is configured to interact with a barbell when the dumbbell support is in the extended configuration.

8. A dumbbell support system, comprising:
a support structure;
a biasing article; and
a system support, wherein the system support is securely associated with the support structure and includes,
a barbell support having a barbell support shaft and a dumbbell support shaft guide, wherein the dumbbell support shaft guide defines a guide cavity and includes an anchoring pin located within the guide cavity; and
a dumbbell support having a dumbbell support shaft and a dumbbell support tray, wherein the dumbbell support shaft includes a support body pin cavity configured to contain the anchoring pin and wherein the dumbbell support shaft is connected to the biasing article and movably associated with the barbell support shaft to be configurable between a first configuration and a second configuration and wherein when the dumbbell support is located in the first configuration and a dumbbell is located on the dumbbell support tray, the dumbbell is tilted such that the anchoring pin is located within the support body pin cavity.

9. The dumbbell support system of claim 8, wherein the biasing article is at least one of,
a spring which is further connected to the barbell support, and
a retraction article movably associated with the support structure, wherein the retraction article is configured to include a weighted object.

10. The dumbbell support system of claim 8, wherein the barbell support includes a barbell support shaft cavity configured to rest on and contain a barbell.

11. The dumbbell support system of claim 8, wherein the dumbbell support shaft guide defines a guide cavity and includes an anchoring pin located within the guide cavity.

12. The dumbbell support system of claim 11, wherein the dumbbell support shaft includes a support body pin cavity configured to contain the anchoring pin, wherein when the dumbbell support is located in the first configuration and a dumbbell is located on the dumbbell support tray, the dumbbell is tilted such that the anchoring pin is located within the support body pin cavity.

* * * * *